United States Patent [19]

Chandler et al.

[11] Patent Number: 4,990,094

[45] Date of Patent: Feb. 5, 1991

[54] DATA DISTRIBUTION PANEL

[75] Inventors: Curtis S. Chandler, King; George H. Foster, Jr., Winston-Salem; David Lane, Greensboro; Ned A. Sigmon, Clemmons, all of N.C.

[73] Assignee: AMP Incorporated, Harrisburg, Pa.

[21] Appl. No.: 390,598

[22] Filed: Aug. 7, 1989

Related U.S. Application Data

[63] Continuation-in-part of Ser. No. 323,043, Mar. 10, 1989, abandoned, which is a continuation of Ser. No. 136,220, Dec. 21, 1987, abandoned.

[51] Int. Cl.[5] ..... H01R 4/66

[52] U.S. Cl. ..... 439/108; 439/544; 439/557; 439/607

[58] Field of Search ..... 439/101, 108, 535, 536, 439/544, 557, 607, 608, 609, 610; 174/59, 60

[56] References Cited

U.S. PATENT DOCUMENTS

| | | | |
|---|---|---|---|
| 3,474,385 | 10/1969 | Cefarelli et al. . | |
| 4,337,989 | 7/1982 | Asick et al. . | |
| 4,386,814 | 6/1973 | Asick . | |
| 4,501,459 | 2/1985 | Chandler et al. . | |
| 4,508,415 | 4/1985 | Bunnell . | |
| 4,571,012 | 2/1986 | Bassler | 439/101 |
| 4,582,376 | 4/1986 | Olsson . | |
| 4,602,833 | 7/1986 | Grabbe et al. . | |
| 4,619,494 | 10/1986 | Noorily et al. . | |
| 4,641,906 | 2/1987 | Olsson . | |
| 4,653,825 | 3/1987 | Olsson . | |
| 4,659,163 | 4/1987 | Althouse et al. . | |
| 4,671,599 | 6/1987 | Olsson | 439/188 |
| 4,678,251 | 7/1987 | Willard | 439/61 |
| 4,681,386 | 7/1987 | Boulanger | 439/347 |
| 4,682,836 | 7/1987 | Noorily et al. | 439/426 |
| 4,725,249 | 2/1988 | Blackwood et al. | 439/535 |
| 4,756,695 | 7/1988 | Lane et al. | 439/76 |
| 4,859,201 | 8/1989 | Marsh | 439/290 |

OTHER PUBLICATIONS

IBM Cabling System Planning and Installation Guide, Ch. 7.

IBM Technical Disclosure Bulletin dated 10–73 entitled "Hermaphroditic Connector", vol. 16, No. 5, pp. 1505, 1506.

*Primary Examiner*—Neil Abrams
*Assistant Examiner*—Khiem Nguyen
*Attorney, Agent, or Firm*—Bruce J. Wolstoncroft

[57] ABSTRACT

A data distribution panel includes a conductive panel having openings for the receipt of electrical data connector from the rear thereof. Shielded data connectors are installed from the rear of the panel and are electrically commoned to the panel. The electrical connectors are in the form of shielded subassemblies which, when interconnected to the panel, are commoned by a finger which extends from the panel thereby contacting the subassemblies. The panel is for use with a patch cable having at each end, connectors which can be latchably interconnected to the panel to interconnect shielded subassemblies together. An interface member is also available which can interconnect electrical connectors thereto which have T-bars and T-slots.

28 Claims, 19 Drawing Sheets

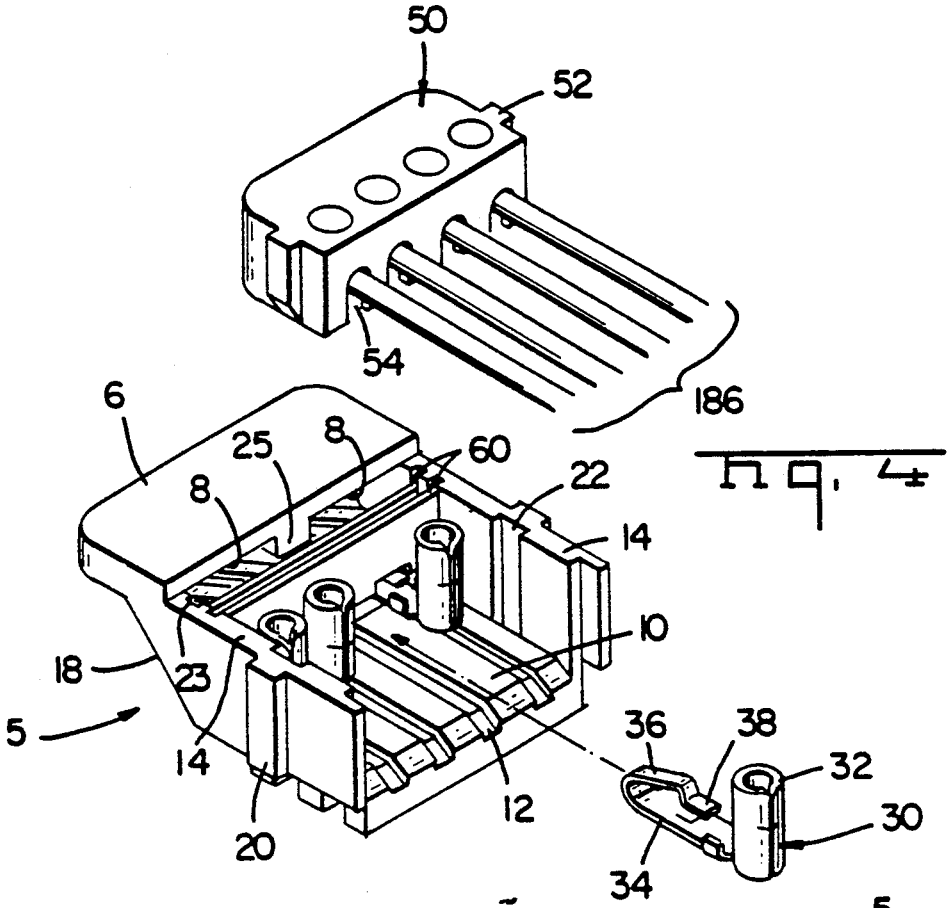
Fig. 4
Fig. 5
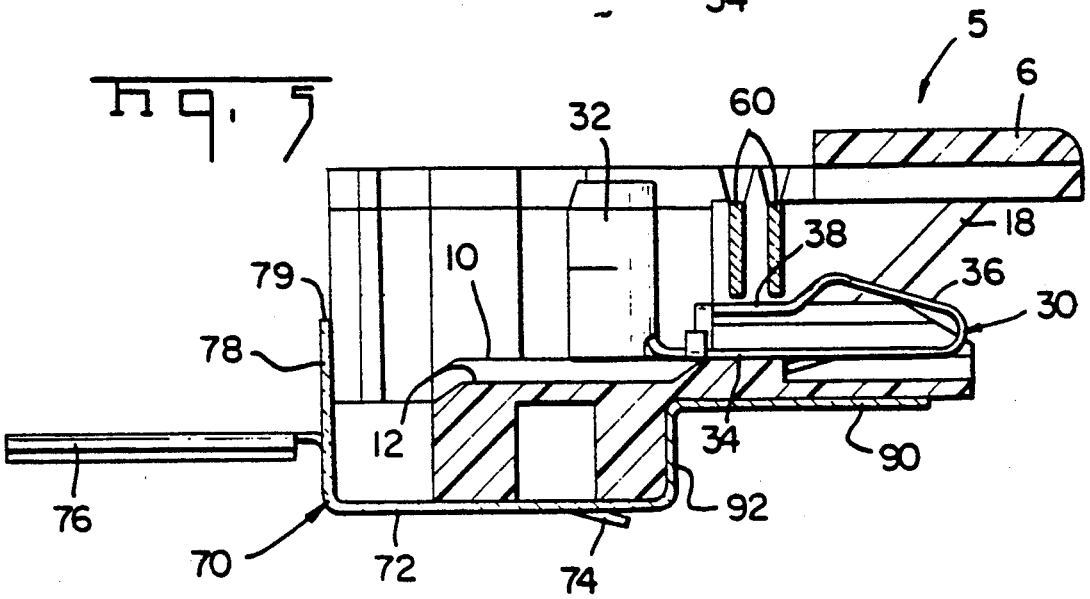

DATA DISTRIBUTION PANEL

This application is a continuation in-part application of Ser. No. 323,043 filed March 10, 1989, and now abandoned, which is a continuation application of Ser. No. 136,220 filed Dec. 21, 1987 and now abandoned.

BACKGROUND OF THE INVENTION

1. Field of the Invention

The invention relates to a data distribution panel for the selective interconnection of shielded cables to and from different destinations.

2. Description of the Prior Art

U.S. Pat. No. 4,501,459 discloses a local area network connector specifically intended for use in the data communications industry. These connectors can be employed in a closed loop data communications link in which various equipment such as computer terminals can be interconnected in a system. These connectors are specifically adapted for use in interconnecting numerous micro or mini computers in a computer network in an office environment. Connectors of this type have standard interface dimensions and configurations. These connectors must also be shielded to prevent spurious electrical signals and noise from affecting the signals in the network.

The structure and components of local area network connectors of this type is represented by the structure of the connector shown in U.S. Pat. No. 4,501,459. These connectors include a plurality of spring metal terminals having insulation displacement wire barrels for establishing electrical connection with the individual conductors forming the multi conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to common the upper and lower shields to the cable shielding.

Similar data connectors of this type are shown in U.S. Pat. Nos. 4,449,778; 4,508,415; 4,582,376; 4,602,833; 4,619,494; 4,653,825; 4,641,906; 4,671,599; and 4,682,836.

These above mentioned connectors are utilized with data distribution systems where the various distribution end points are subject to change. For example, several computer terminals could be interconnected to various associated printing stations. If the data cable is continuous between a first point, which could be a terminal, and between a second end, which could be a printing station, the cable would have to be severed at some position within the cable length to interconnect one terminal to a different printing station.

For this reason, data distribution panels are incorporated within the system acting as links to the various end points. These panels are located intermediate the destinations, typically in a wiring closet, and include shielded cable coming from one destination, such as a terminal, which is terminated to an electrical connector and mounted within a panel. A second shielded cable coming from a second destination, such as from a printing station, is interconnected to a second electrical connector and the second electrical connector is mounted within the panel adjacent to the first electrical connector. A patch cable is utilized which includes a short length of shielded data cable having two electrical connectors at opposite ends which are matable with the first and second electrical connectors mounted within the panel. In all likelihood, a mass array of first electrical connectors and a mass array of second electrical connectors are disposed in a matrix and mounted to the panel. Several patch cables are available to change and interconnect, the various interconnections possible between the first and second connectors.

A requirement of these distribution panels is that the shielded cable of the first and second cables is commoned together and to the conductive panel to which the first and second connectors are mounted. To accomplish this, the present designs of distribution panels, include conductive mounting towers or blocks, which are situated behind, and spaced from, a front face of the panel, and include conductive grounding clips mounted thereto. The insulation of the shielded cable must be stripped off of the cable for a distance equal to the spacing from the rear face of the panel to the ground clips. The exposed shield of the cable is then inserted within the grounding clips on the towers to interconnect the shielding braid to the conductive panel.

SUMMARY OF THE INVENTION

The objects of the invention relate to reducing the overall cost of this type of installation by first reducing the cost of the components which are included within the system, and by reducing the labor intensity of installing the equipment.

More particularly, an object of the invention is to design a less expensive electrical connector which can be interconnected from the rear face of the distribution panel which by its interconnection alone, grounds the shield of the connector to the conductive panel, thereby eliminating the labor intensity of stripping each of the cables and grounding them within the grounding clips.

The objects of the invention were accomplished by designing a data distribution assembly which acts as an interface between first and second destinations within a data distribution system, and comprises a plurality of first shielded data cables including a plurality of data conductors having a shielding braid surrounding the conductors, the first shielded data cable having first and second ends where the first end is interconnected to a first destination. The data distribution panel also includes a plurality of first electrically shielded connectors arranged in an array where each connector is electrically interconnected to one of the first shielded data cables and where each connector comprises an insulating housing which supports a plurality of electrical terminals, equal in number to the plurality of data conductors, the terminals being interconnected to the data conductors through insulation displacement portions. The terminals further comprise resilient contact portions for interconnection to similar contact portions in a similar connector, the shielded connectors including shield means in a surrounding relation to the insulative housings, where each shield means includes means for interconnection to the associated shielding braid.

A plurality of second shielded data cables include a plurality of data conductors having a shielding braid surrounding the conductors, the second shielded data cables each having first and second ends where the first end is interconnected to a second destination. One end of each second shielded data cable is interconnected to one of a plurality of second electrically shielded connectors, where the connectors are arranged in an array and where each connector comprises an insulating housing which supports a plurality of electrical terminals, equal in number to the plurality of data conductors. The terminals in the second connectors are interconnected to the second data conductors through insulation displacement portions, the terminals of the second connectors further comprising resilient contact portions for interconnection to similar contact portions in a similar connector, the second shielded connectors including shield means in a surrounding relation to the insulative housings, where each shield means includes means for interconnection to the associated shielding braid.

The data distribution system also includes a conductive panel means for the assemblage of the arrays of first and second data connectors, the panel means including means to directly contact individual shield means of individual first and second shielded connectors, thereby commoning the shielding braids of the first and second shielded connectors to the conductive panel means via the individual shield means of first and second connectors. The data distribution panel further includes a plurality of patch cables where each patch cable includes shielded data cable having shielded patch connectors at opposite ends of each patch cable, the patch connectors being matable with first and second shielded connectors to provide a variable of interconnections between first and second destinations.

In the preferred embodiment of the invention, the first and second electrically shielded connectors are designed as shielded subassemblies where each comprises an insulative housing means having terminal supporting means including a platform for the receipt of a plurality of electrical terminals, and sidewalls upstanding from the platform, the platform and the sidewalls defining an open upper face of the housing means. Disposed within the housing is a plurality of electrical terminals including base portions for mounting on the platform in transition with reversely bent portions forming resilient contact portions, the contact portions extending rearwardly to free ends of the terminals, the contact portions being intermatable with like contact portions in a complementary connector, the terminals further comprising wire connecting portions extending from ends of the terminal base portions. The shielded subassembly also includes an insulative cap member, securable within the housing means, including means for aligning individual wires of the shielded cable with selected wire connecting portions. To shield the insulative housing means the subassembly includes shield means securable to the housing means, which substantially encloses the exterior of the sidewalls, the exterior of the platform, and the open upper face of the platform, thereby overlying the terminal wire connecting portions, the insulative cap member providing a spaced relation between the shield means and the wire connecting portions of the terminals.

BRIEF DESCRIPTION OF THE DRAWINGS

FIG. 3A is an isometric view of the shielded subassembly in an exploded configuration.

FIG. 3B is an isometric view of the shielded subassembly in an assembled configuration.

FIG. 4 is an isometric view of the housing of the shielded subassembly.

FIG. 5 is a cross-sectional view of the insulative housing with the lower shield in place.

FIG. 13 is a side view of the panel shown in FIG. 12.

DETAILED DESCRIPTION OF THE PREFERRED EMBODIMENT

Figure 1:
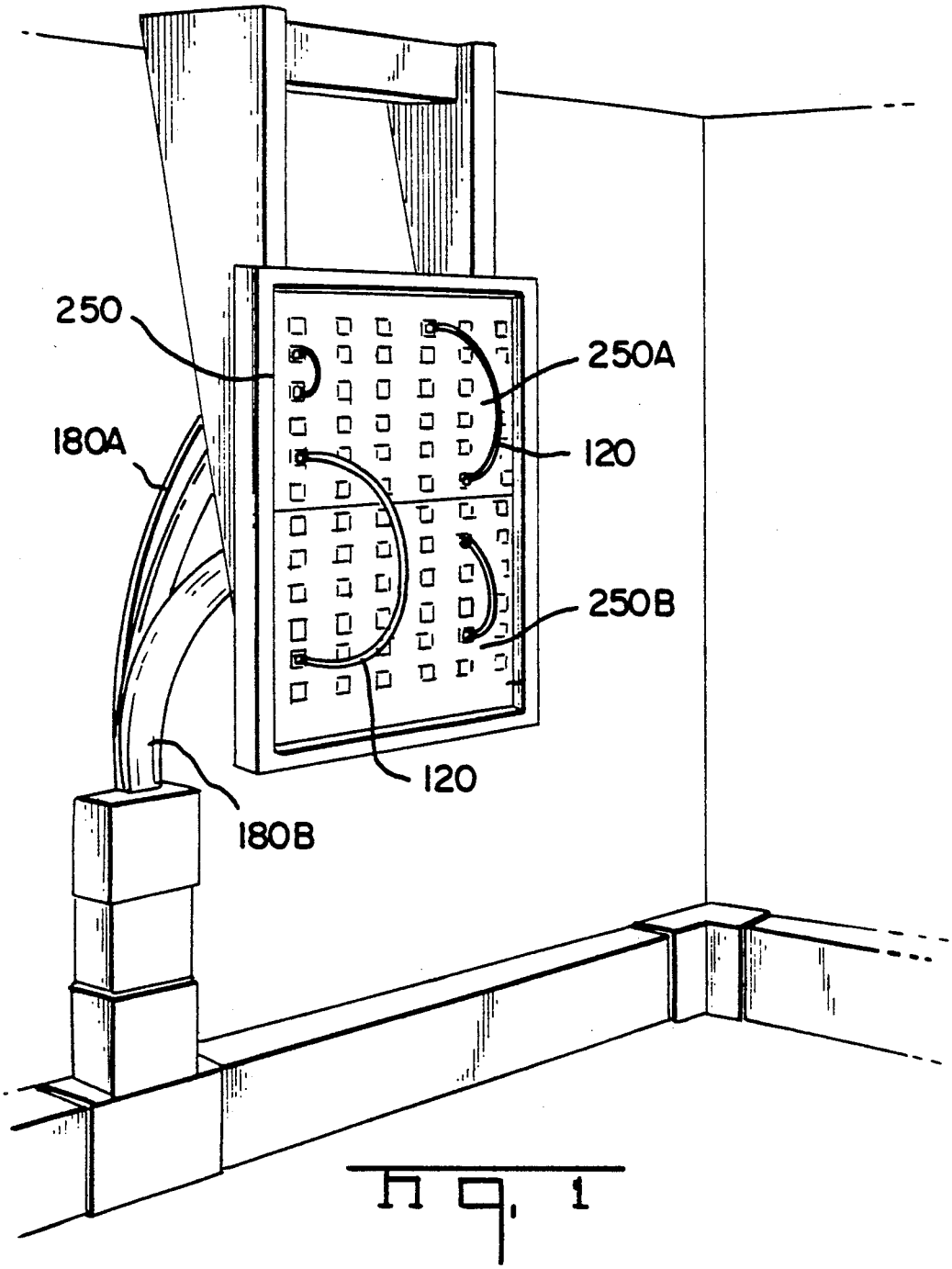
FIG. 1 is a pictorial view of the data panel of the instant invention.

Referring first to FIG. 1 shows the data distribution panel of the instant invention as generally including a conductive panel, such as 250, which would include upper and lower panels, such as **250*a* and 250*b*. Shielded data cable, such as 180*a* and 180*b*, would be terminated to an electrical connector and latched to the rear of the panels 250*a* and 250*b*, and each of the shielded data cables 180*a* and 180*b* would be terminated at their opposite ends to a user point. It should be noted that all cables such as 180*a* follow a similar route through a building to a similar destination while the cables such as 180*b* follow an opposite route and terminate in another location. It is typical then that all connectors which connect to cables 180*a* are grouped into an array of connectors within one panel, such as 250*a*, while all connectors which interconnect to cables such as 180*b* are grouped into a second similar array of connectors within a panel such as 250*b***. However it should also be noted that such a grouping is not requisite for the type of distribution panel discussed herein, but is only mentioned as illustrative to a typical distribution panel.

Figure 2:
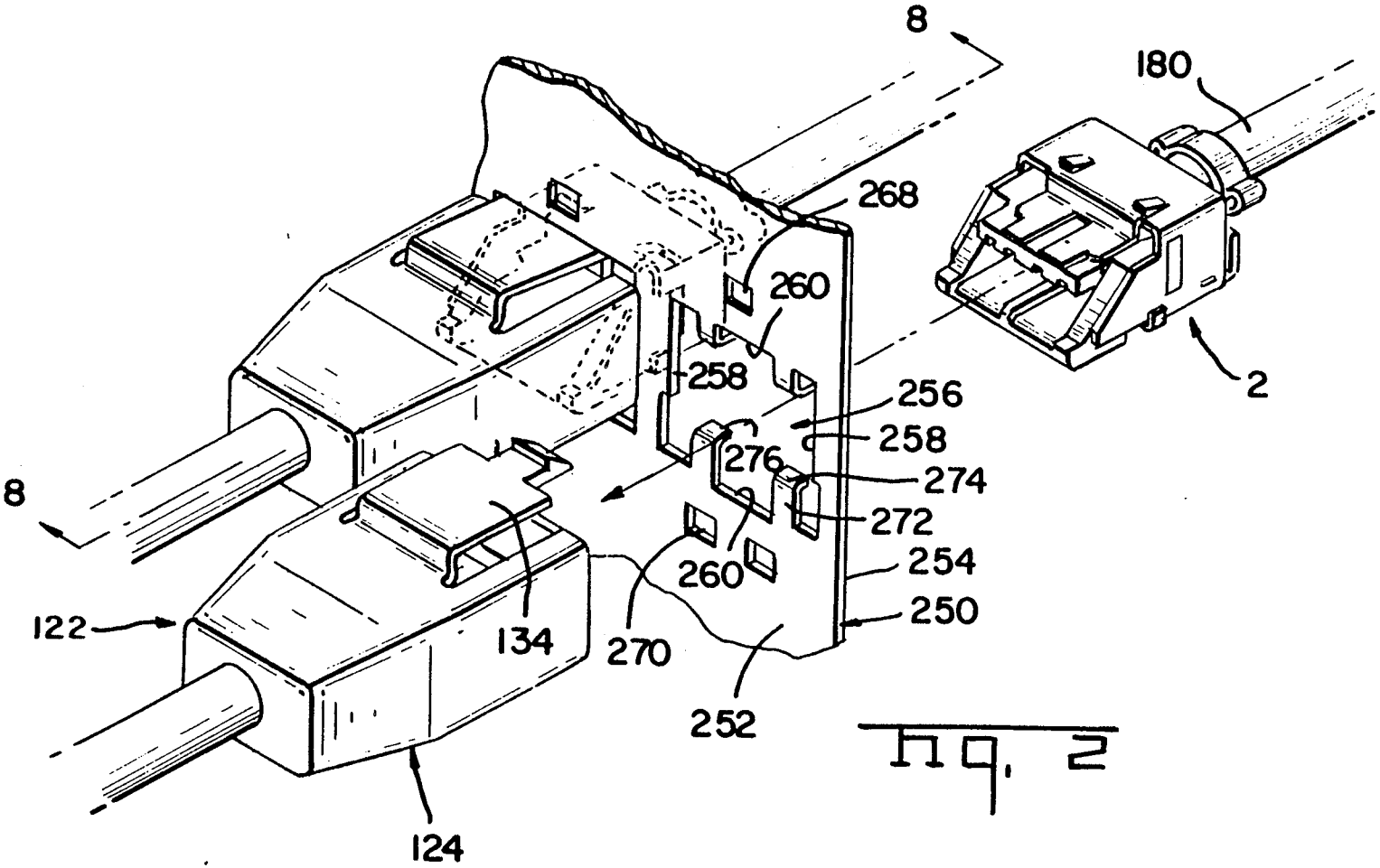
FIG. 2 is an isometric view of the data panel of the instant invention showing a mating connector poised for receipt.
Figures 7A, 7B:
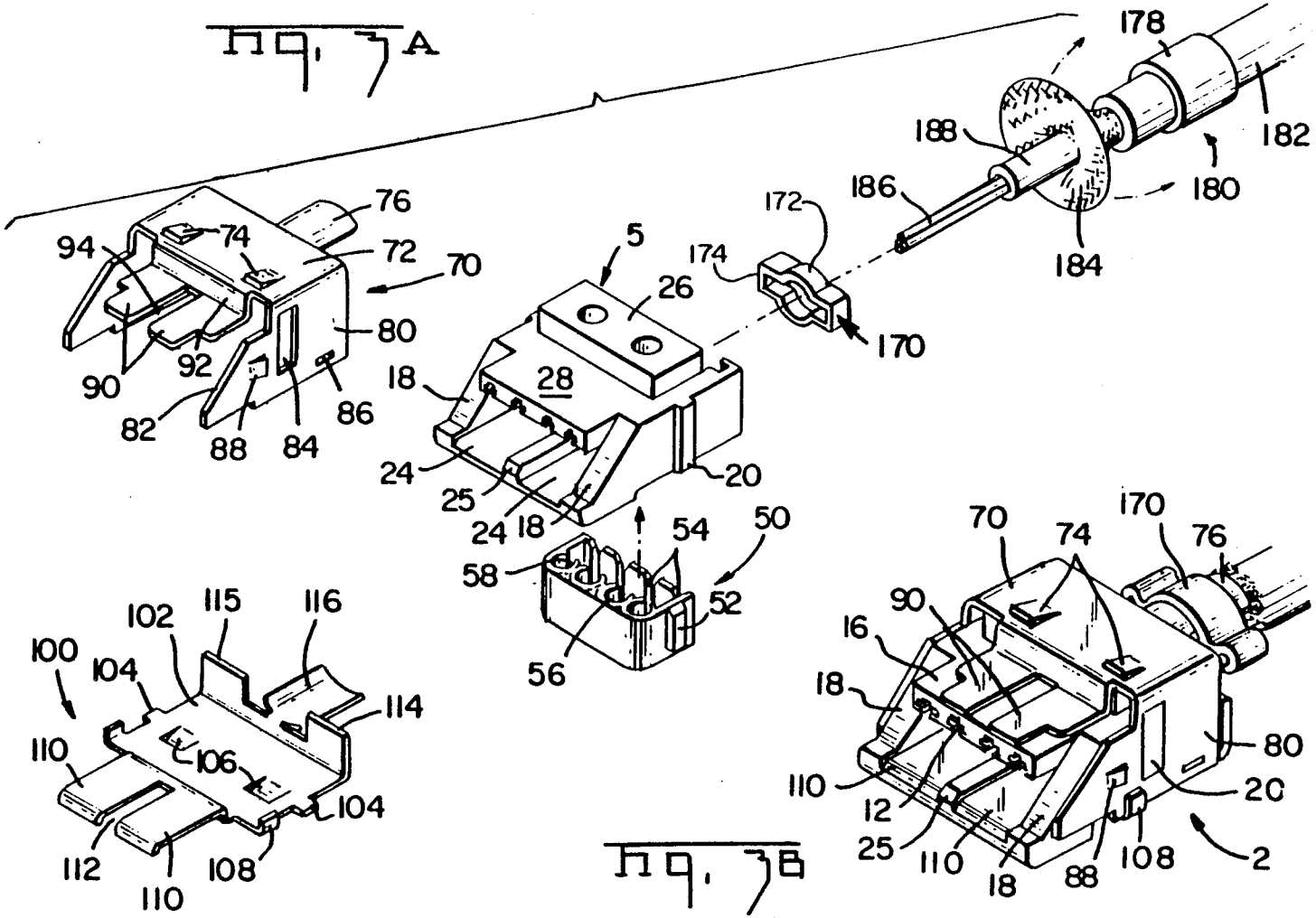
FIG. 7 is an isometric view of the insulative housing of the instant invention partially broken away to show the internal structure.

Patch cables, such as 120, are included which electrically interconnect a selected shielded data cable 180*a* to a selected shielded data cable 180*b*. The electrical interconnection between data cables 180*a* and 180*b* may be changed by merely disconnecting one or both ends of the patch cable 120 and selecting a new interconnection point to a new shielded data cable. With reference now to FIG. 2, the conductive panel will be described in greater detail, although the description will be to a conductive panel generally termed 250 and will be identical whether used as panel 250*a* or 250*b*.

Conductive panel 250 includes a front mating face, such as 252, and a rear face 254 having a plurality of connector receiving openings 256 therein. Each of the openings 256 is generally defined by sidewalls 258 and lower and upper walls 260. A plurality of fingers 272 extend upwardly and downwardly, respectively, from the lower and upper walls 260, and each finger 272 includes a contact portion 274 and a free end 276.

Referring now to FIGS. 3A—4, the shielded subassembly 2 generally includes a housing member 5, a stuffer cap 50, and shield members 70 and 100. The data connector housing 5 will be described in greater detail, with reference to FIGS. 3A and 4.

With reference first to FIG. 4, the housing 5 generally comprises a terminal support floor 10 having a plurality of channels 12 therein for receiving terminals 30. Extending upwardly from the terminal support floor are sidewalls 14 having internal grooves 22 and external ribs 20. A bridge portion 6 extends across the two sidewalls and below the bridge 6 is a rib 25 which extends from the rear edge of the bridge (FIG. 4) to the forward edge of the bridge (FIG. 3A). The rib 25 defines two windows 8 which also extend from the rear edge of the bridge to the forward edge of the bridge to define two shield receiving surfaces 24 (FIG. 3A). The sidewalls 14 extend from the rear of the data connector housing 5 to the front mating face of the data connector to define two 45 degree surfaces at the front mating face, referred to generally as 18.

Terminals 30 include insulation displacement wire barrels 32, a blade portion 34, a resilient contact portion 36 and a commoning foot 38. The resilient contact portion 36 is looped back upon itself and spaced above the terminal support floor. The resilient contact portion 36 is disposed at the front mating face of the housing 5 for overlapping interconnection with like terminals, the two resilient contact portions of mating connectors contacting each other to deflect respective resilient contact portions towards the blade portion of respective terminals.

Stuffer cap 50 includes alignment ribs 52 along the sides, wire receiving slots 54 and stuffer cylinders 56, the stuffer cylinders 56 having an inside diameter larger than the outside diameter of the barrels 32 of the terminals 30.

Referring now to FIG. 3A, the shield member 70 includes a plate member 72 with continuous shield members 90 extending from the plate member 72 through a bent portion 92, the two shield members 90 defining a slot 94 therebetween. The plate member 72 further includes two locking lances 74. The shield member 70 is shown in FIG. 5 as including a rear wall 78 extending from the plate member 72 with a semicircular shielding tail 76 extending from the rear wall 78. With reference again to FIG. 3A, the shield member 70 further includes integral sidewalls 80 having apertures 84 and 86 stamped therefrom. The forward edges of the sidewalls 80 are defined by two 45 degree surfaces 82.

Shield member 100 is shown as including a plate member 102 with integral shielding portions 110 extending from the front edge thereof, the two shield members 110 defining a slot 112 therebetween. The shield member 100 further includes a rear wall portion 114 having a semicircular shield tail 116 extending from the rear wall 114. Plate member 102 further comprises locking lances 106, and tabs 104 and 108 extending from the side edges thereof.

The assembly further includes a ferrule 170 having semicircular portions 172 and collapsible portions 174. The shielded cable 180 includes outer insulation 182, a shielding braid 184, inner insulation 188 and individual insulated conductors 186.

To interconnect the shielded cable 180 to the electrical terminals, the housing portion 5, of FIG. 4, is first assembled. With the shorting bars 60 removed, the terminals 30 are slidably received in respective channels 12 until latched in place. The shorting bars 60 are then inserted in respective grooves 23, the shorting bars 60 contacting the commoning foot 38 on alternate terminals to common alternate terminals when the data connector 4 is in an unmated condition. Also, prior to preparing the end of the cable, the collapsible ferrule 170 is slid over the end of the cable and is placed back upon the cable for later use.

The end of the shielded cable can then be prepared by stripping a portion of the outer insulation 182 from the end of the cable to expose a portion of the shield 184, the exposed shielding braid 184 is dressed over the outer insulation 182, as shown in FIG. 3A. Stripping the outer insulation 182 exposes the insulated conductors 186 and each individual wire 186 is placed in the stuffer cap 50 through a respective slot 54, with the ends of the wire 186 extending into the barrels 56 through the slot 58. The stuffer cap 50 and the individual wire 186 are then placed over the insulative housing 5 such that ribs 52 on the stuffer cap 50 are aligned with channels 22 in the insulative housing 5, which in turn aligns the stuffer cap barrels 56 with the insulation displacement wire barrels 32 on the terminals 30. The stuffer cap 50 is then pushed downwardly until each of the individual conductors 186 is terminated within respective wire barrels 32 of terminals 30.

With the conductors terminated, the shield members 70 and 100 can be assembled to the housings. The shield member 70 is first assembled to the insulative housing 5 such that the apertures 84 in the shield member overlie the ribs 20 on the exterior of the insulative housing. When the shield member 70 is placed over the housing, the shield extension tail 76 overlies the dressed braid 184. The shield member 100 is then assembled to the insulative housing 5 with the shield contact portions 110 disposed within the windows 8 (FIG. 4) of the insulative housing such that the shield contact portions 110 lie adjacent to surfaces 24, as shown in FIG. 3B. Shield member 100 is held in place to shield member 70 with tabs 104 on each side edge of plate member 102 being disposed within apertures 86 in the sidewalls 80 of the shield member 70. To retain the two sidewalls 80 from outer expansion, two flaps, such as 108, are bent over the sidewalls 80 of the shield member 70 which also retain the downward movement of the flat plate portion 102 of the shield member 100. With the shield member 100 so installed, the shielding extension tail 116 also overlies the shielding braid as the two shielding tails 76 and 116 are complementary semicircular portions.

As installed, the plate member 102 of the shield member 100 overlies the terminals 30 within the connector housing 5. The rear wall 114 of the shield member 100 encloses the rear edge of the connector housing 5 with edge 115 of the rear wall 14 substantially adjacent to edge 79 (FIG. 5) of rear wall 78 to totally enclose the connector housing. Also as installed, the semicircular shield tail 116 overlies and is substantially adjacent to the dressed braid. The previously installed ferrule 170 can then be slid forwardly to overlie the semicircular shield tails 76 and 116, and the ferrule 170 can be crimped to a configuration as shown in FIG. 3B. The collapsible ferrule provides for a permanent electrical connection between the shielding components, that is, the shielding braid 184 is trapped beneath the metallic shield tails 76 and 116. It should be understood that the crimped connection also provides for an excellent strain relief as the shield member are crimped directly to the outer insulation of the data cable.

It should be understood that the above mentioned assembly is compatible with the commercially available data cables, such as plenum and non-plenum configurations of Data Cable Types 1, 2, 6 and 9. However as Type 9 data cable includes an outer diameter which is smaller than other data cables, a NYLON spacer, such as 178 (FIGS. 3A and 6) can be used as a spacer.

It should be understood that the assembly as previously described can be installed within the user's facility without any assembly equipment. At most, a pocket knife is required to strip the cable and a pair of pliers is required to push the stuffer cap down to terminate the insulated conductors, and to crimp the ferrule 170.

Figure 8:
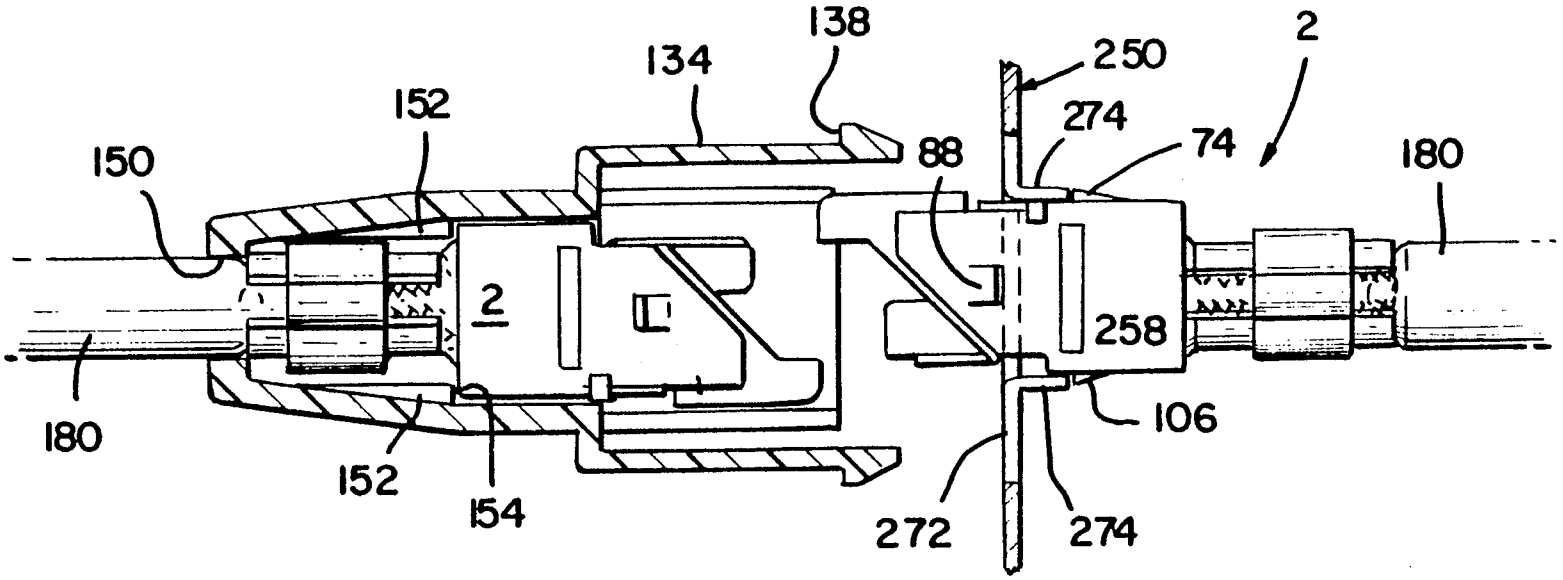
FIG. 8 is a cross sectional view through lines 8—8 of FIG. 2.

With the shielded subassembly 2 assembled as previously described, the shielded subassembly is prepared for receipt within the conductive panel 250. A shielded subassembly 2 can be inserted through the rear face 254 into each of the openings 256 such that the tabs 88 on either side of the shielded subassembly snap past the sidewalls 258 (shown in phantom in FIG. 8) retaining the shielded subassembly from moving in one direction. The fingers 272 which extend from the upper and lower edges 260 of the conductive panel 250 serve two functions. First, the free ends 276 of the fingers 272 abut the ends of the tabs 74 and 106, as shown in FIG. 8, which retain the shielded subassembly from moving forward within the openings 256 of the conductive panel 250. Thus the tabs 88, 74 and 106 cooperatively retain the shielded subassembly 2 in retention within the conductive panel 250. Second, the fingers 272 have contact portions 274 which abut the upper and lower shield portions, thereby commoning the shielded subassembly 2 to the conductive panel 250. With the conductive panel 250 fully loaded with a mass array of shielded subassemblies 2, the distribution panel can be programmed by the use of patch cables 120 to direct the interconnections between shielded cables, such as between data cables **180*a* and 180*b* shown in FIG. 1**.

Figure 6:
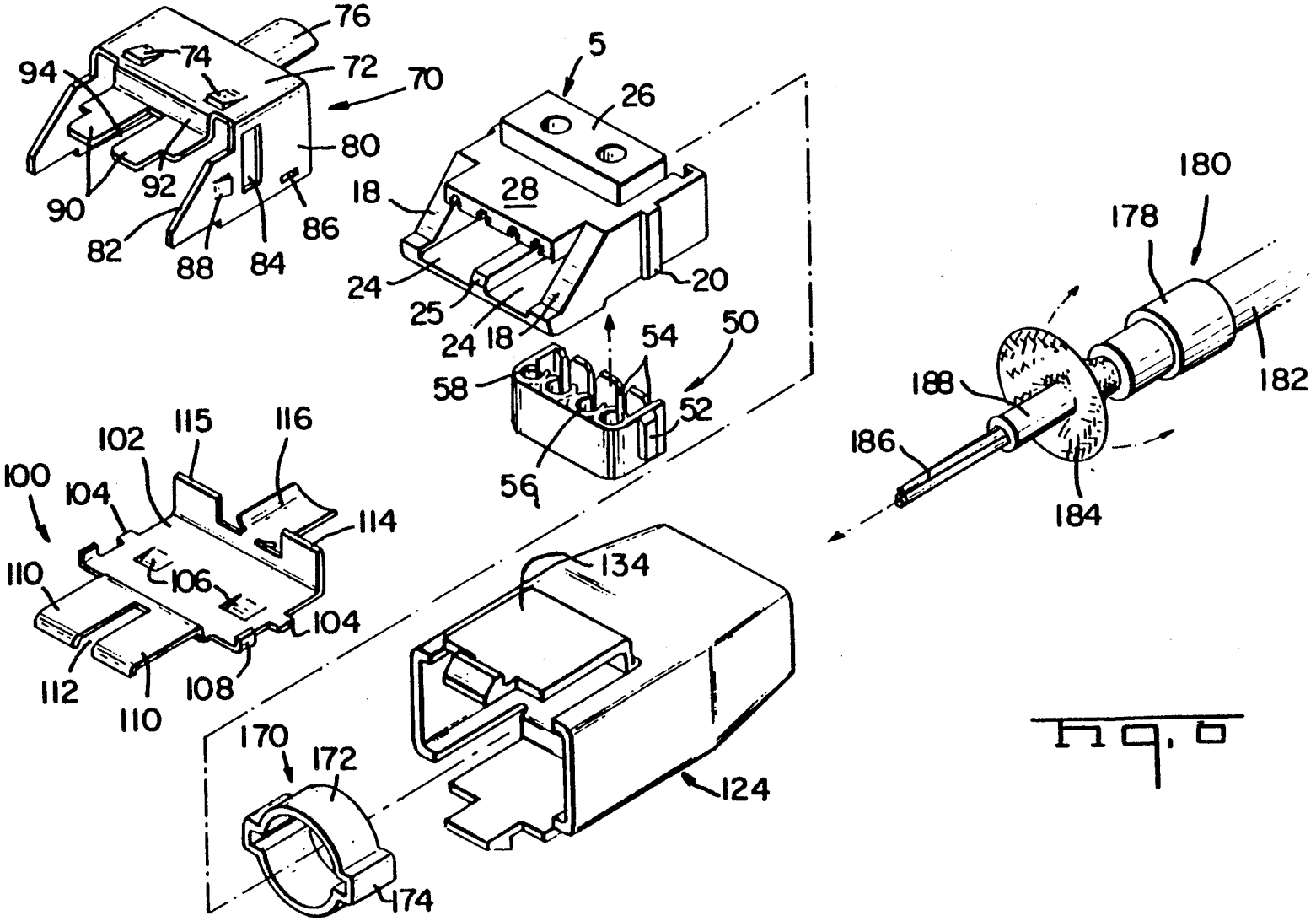
FIG. 6 is an exploded view showing the connector assembly which mates with the panel of the instant invention.

With reference to FIG. 6, one version of the patch cable will be described in detail. The patch cable 120 can generally include an insulative housing, such as 124, which incorporates therein a shielded data cable 180 which is similar and complementary with the data cable which is used in the data distribution panel. The inner core of the patch connector 122 is identical to the shielded subassembly 2 which was previously described.

Figure 7:
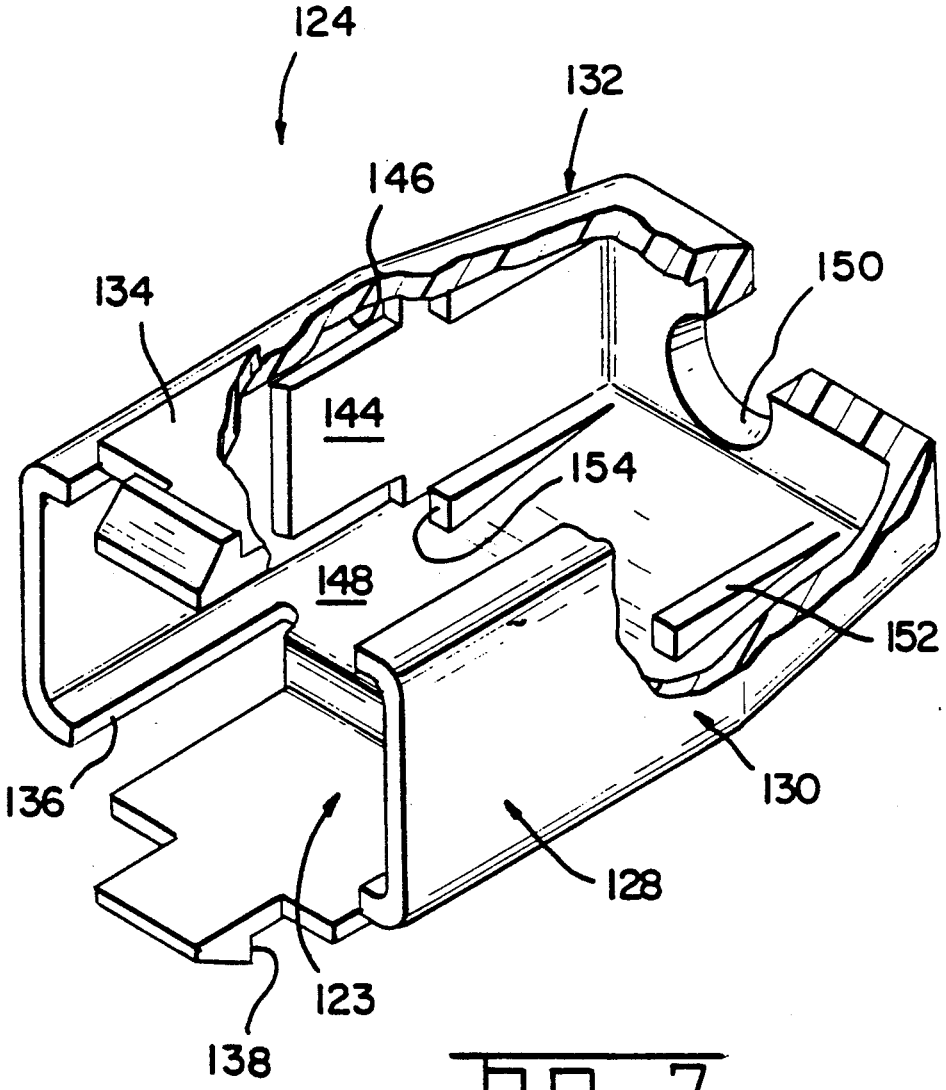

With reference to FIG. 7, the insulative housing 124 would generally include a connector receiving cavity, such as 123, having sidewalls 144 and a lower floor 148 with an upper wall 146. The housing generally includes a forward latching portion 128, a central body portion 130 and a rear cable receiving section 132. The rear portion 132 includes two ribs, such as 152, disposed on the lower and the upper Walls having stop surfaces such as 154. The rear wall of the insulative housing 124 has a cable receiving opening, such as 150 therethrough, for the entry of the shielded data cable, such as 180.

The patch cables 120 would be similarly assembled as the shielded subassemblies previously described, although the shielded data cable 180 must be inserted through the cable receiving opening 150 of the insulative housing 124 prior to its preparation. The data connector 122 is more fully described in co-filed patent application Ser. No. 136,090. After the cable is inserted through the opening 150, a collapsible ferrule 170 is placed over the end of the cable. The outer insulation could then be stripped and the shielded braid, such as 184, could be dressed over the outer insulation. The conductors, such as 186, are then terminated to the respective terminals 30 as previously described with reference to the assemblage of the shielded subassemblies 2. It should be noted that one of the connectors 122 will be at each end of the patch cable for interconnection to selected shielded subassemblies 2 in the panel 250. Once the shielded subassemblies at each end of the patch cable are assembled, the insulative housing 124 can be slid forwardly until the rear walls of the shield members 70 and 100 abut the stop surfaces 154 of the housing. The shielded subassembly 2 and the housing 124 are interferingly fit such that the struck out tabs 74 and 106 are deflected inwardly which retain the shielded subassemblies 2 within the insulative housings. It should be noted that by having the shielded subassemblies interference fit within the housings, that the housings can be molded from a single draw mold which greatly simplifies the molding procedures and which greatly reduces the cost of the molds to be produced. Said differently, the housings 124 do not require latching shoulders to retain the housings in place, latches which would require side draw dies within the mold.

With the patch cables fully assembled, the patch cables 120 can be interconnected to selected shielded subassemblies 2 contained within the data distribution panel 250 to interconnect selected data cables **180*a* to 180*b*. As shown in FIG. 2, the latches 134 are resiliently deflectable inwardly such that upon movement of the housing 124 into registration with the conductive panel 250, the latches bias inwardly until the latch surfaces 138 (FIG. 7) are engaged with the rear face 254** of the conductive panel.

It should be noted from FIGS. 2 and 8 that a portion of the shielded subassemblies 2 project from the rear of the conductive panel 250 through the front face of the panel. The housings 124 were designed such the shielded subassemblies 2 within the housing were slightly recessed therein. This allows a flush mount fit of the housings 124 against the front face 252 of the panel 250, as shown in FIG. 2, insulating those portions of the shielded subassemblies which project through the rear face. The patch cable connectors are easily removable by compressing the upper and lower latch members 134 which releases the data connectors for interconnection to various other shielded subassemblies 2.

Figure 9:
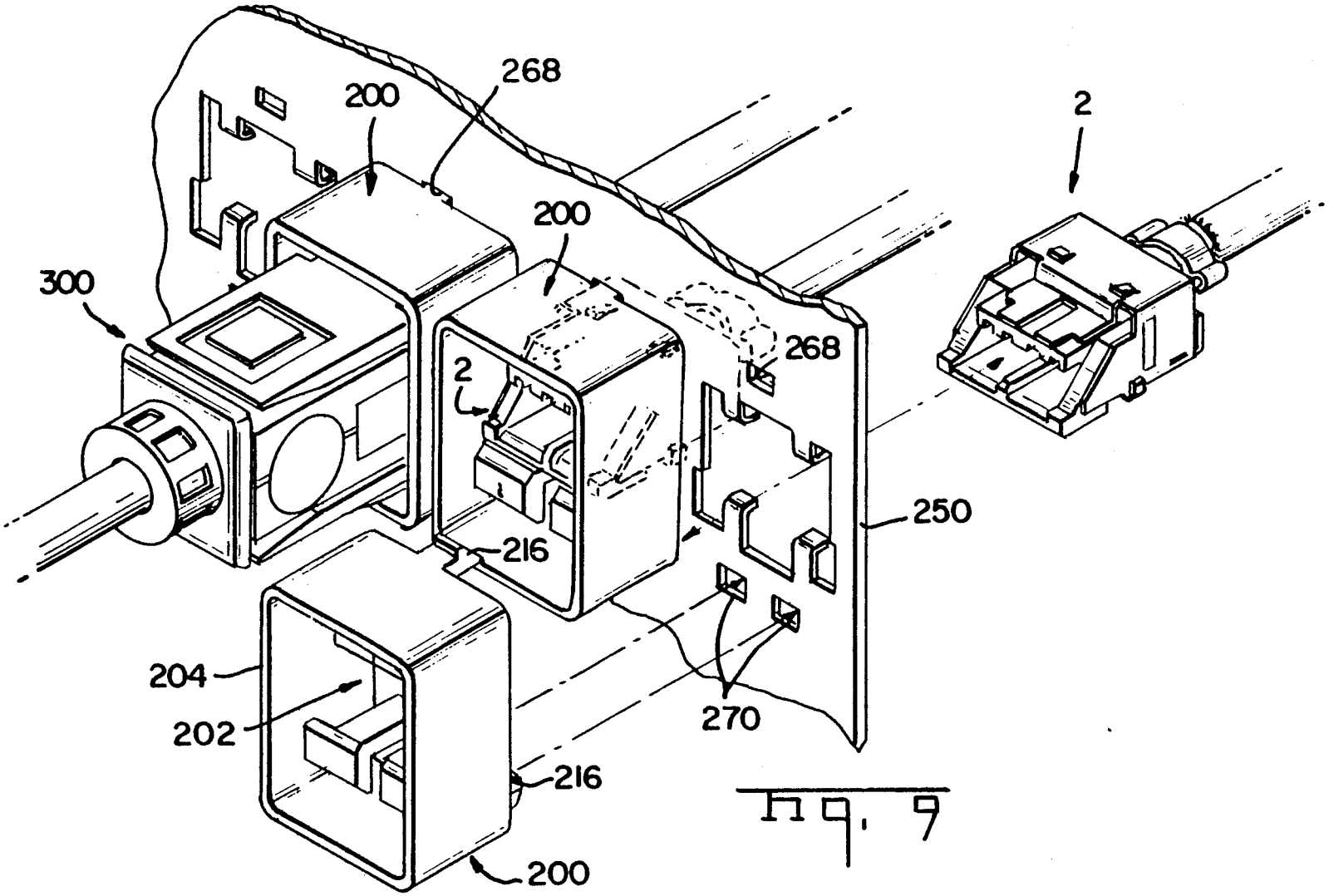
FIG. 9 is an isometric view of a modification to the data panel to change the latching configuration.
Figure 10:
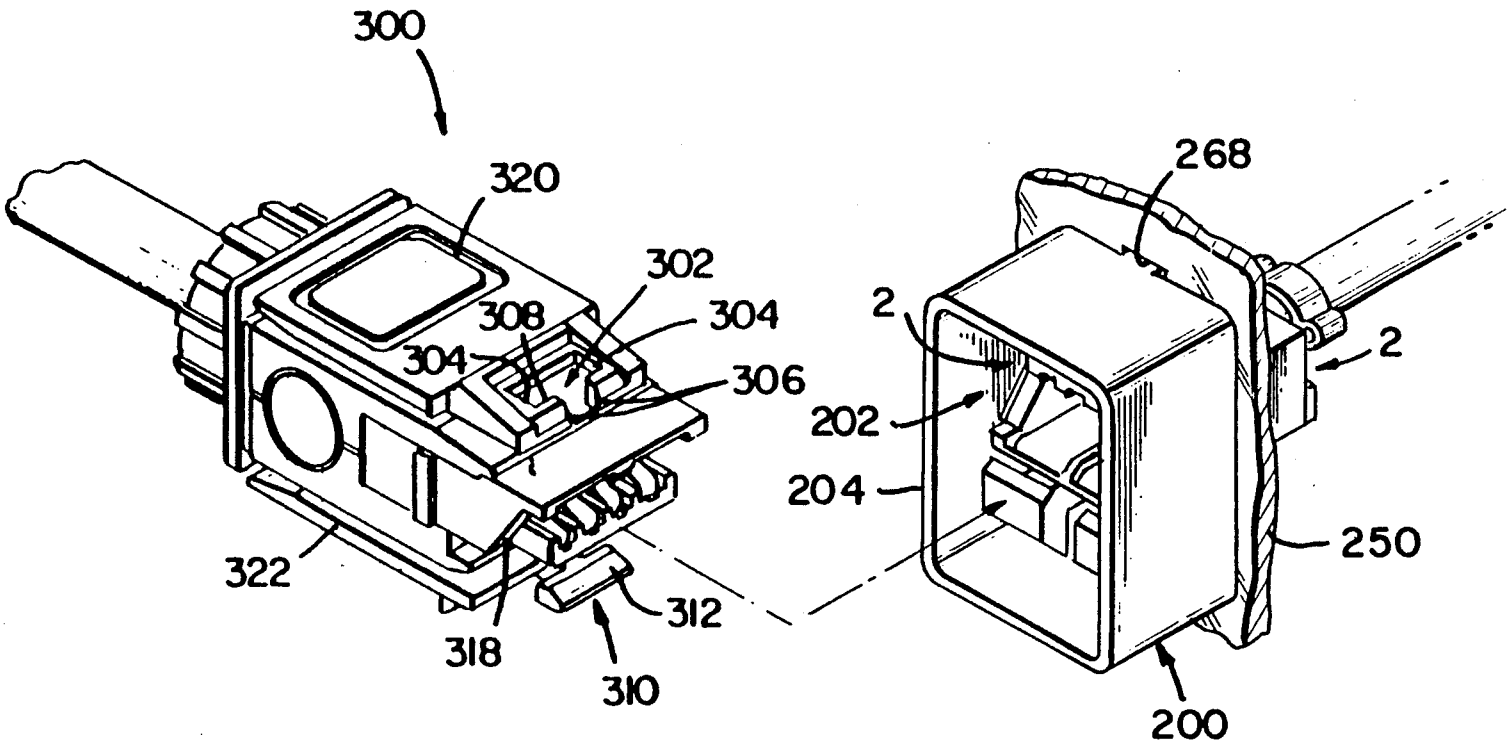
FIG. 10 is an isometric view similar to FIG. 8 showing the mating connector poised for receipt.

With reference now to FIG. 9, a modification can be made to the previously described data distribution panel where patch cables are used where the connectors at each end of the patch cable are similar to the connectors shown in U.S. Pat. No. 4,501,459. In all respects, conductive panel 250 and the shielded subassemblies 2 are identical to those previously described. As shown in FIGS. 9 and 10, electrical connectors such as 300 can also be used as ends to patch cables. However connectors 300 have latch plates 320 and 322 having a T-bar 310 and a T-slot 302 which are hermaphroditically interconnectable to a T-slot and a T-bar on an associated data connector. In this instance, however, since the connector 300 is not interconnected to another identical connector, an interface, such as 200, must be incorporated into the data distribution panel 250.

The interface 200 generally comprises a shroud member 204 forming a peripheral wall surrounding the data connection opening to partially insulate the electrical connection between the two mating electrical components. The shroud member 204 defines an internal upper surface 210, a lower surface 208 and side surfaces 214 and 212. Also within the periphery of the shroud 204 are back wall sections 226, and 228. In between the wall portion 226 and 228 is an opening defined by edge 234 of rear wall 226, edge 236 of rear wall 228 and the sidewalls 212 and 214. This opening is defined to allow the placement of the interface 200 over the shielded subassemblies 2 which are latched to the rear face 254 of the panel 250.

Also within the periphery of the shroud member 204 is a T-bar member 220 and a T-slot member 240. The T-bar 220 and the T-slot 240 are profiled to simulate the T-bar and T-slot of the data connectors as previously described, for example in U.S. Pat. No. 4,501,459. Referring first to the T-bar member 220, the member generally includes a bar member 224 interconnected to the internal surface 210 and to the rear wall 226. The rear surface of the bar 224 defines a latching surface, and directly behind the latching surface of the bar 224 and defined in the rear wall 226 is a pair of apertures 230 which extend through the wall and are generally defined by the retractable pins which define the rear latching surfaces during the molding process.

Figure 11:
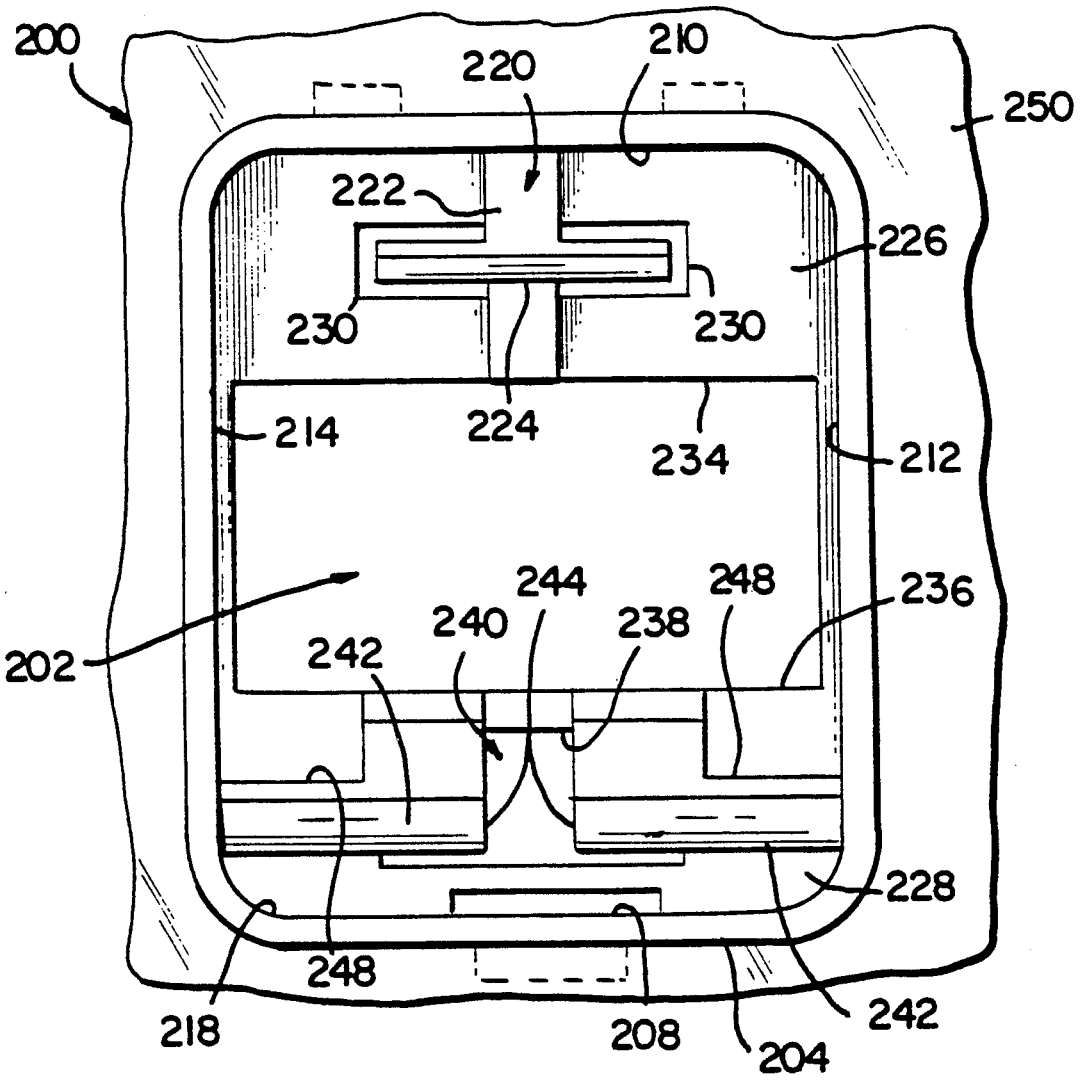
FIG. 11 is a front plan view of the face plate which includes the modified latching configuration.

Referring still to FIGS. 11, the detail of the T-slot will be described in greater detail. The T-slot extends between sidewalls 212 and 214 and is integrally molded therein. The rear portion of the T-slot is integrally molded with the back wall portion 228 and include arms 242 extending inwardly from the sidewalls 212 and 214 towards the center of the interface. Each of the arms 242 is spaced from each other as defined by end surfaces 244 which define a slot therebetween. The rear edge of the arms 242 each define a latching surface, which is similarly formed by retracting pins of the dies during the molding process thereby leaving a window 238 behind the rear edge of the arms 242.

As shown in FIGS. 9 and 10, the interface member 200 includes latches 216 which are complementary with the apertures 268, 270 for retaining the interface member 200 to the panel 250. When the interface members 200 are placed over the shielded subassemblies 2, the opening within the interface member 200 surrounds the shielded subassembly. The T-bar 220 and the T-slot 240 of the interface member simulate the T-bar 310 and T-slot 302 of a matable hermaphroditic connector, identical with connector 300. Thus, the interface member 200 provides a complementary latching arrangement for the interconnection of the patch cable having a data connector such as 300 as each end.

Figure 12:
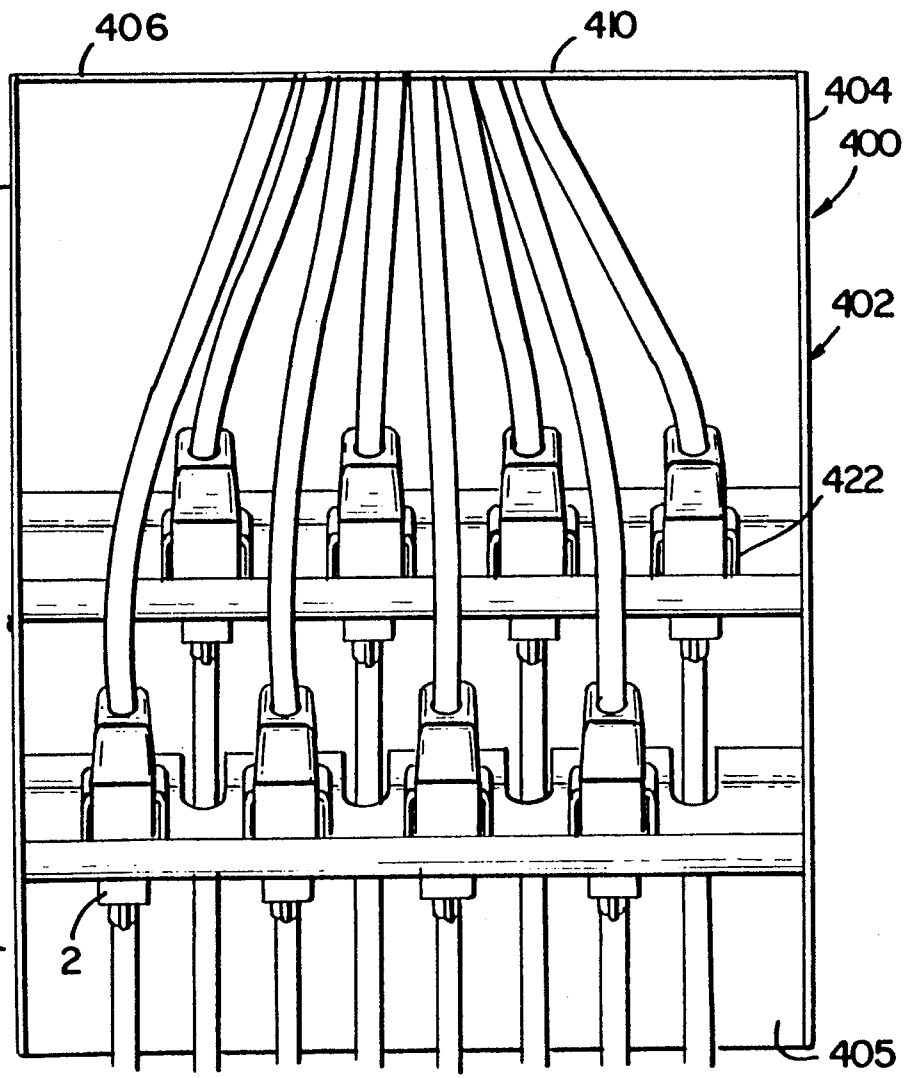
FIG. 12 shows an alternate version of distribution panel.
Figure 11:
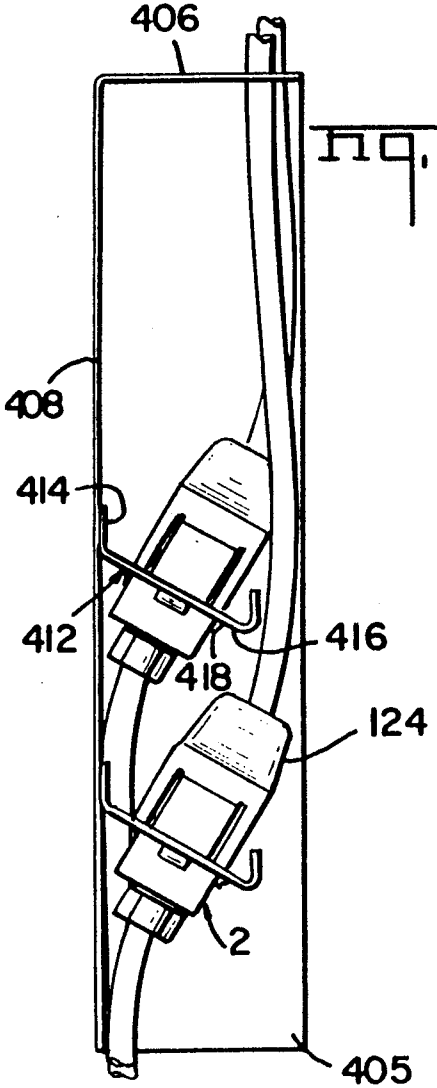

With reference now to FIGS. 12 and 13, a further distribution panel 400 is shown which includes a distribution box such as 402 which includes a base portion 408, sidewalls 404, and a rear wall 406. Cable leadouts such as 410 would be included which would open to the exterior of the box 402. The interior of the box 402 would include mounting panels 412 which include sections 414 interconnected to the base wall 408 by means such as spot welding, or the like. The mounting panels include walls such as 416 which extend across the box 402 at an angle relative to the base wall 408. Each of the walls 416 would include a plurality of openings 422 which would be profiled as the openings 256 described above and would include fingers such as 418 which are integral therewith. The openings 422 would be staggered which facilitates easy cable management through the rear wall 406 through openings 410 and through the front face 405.

This distribution panel 400 could be centrally located within a portion of a building where interconnections are likely to rapidly or periodically change and where continual access to the wire closet would be inconvenient. This may be located within a computer room having a plurality of network tied to computer terminals or it may be located out on the floor within a centrally located work station area. In any event it should be appreciated that this distribution box would allow easy access to the network interconnections.

With the box located within a central area of a building, a plurality of shielded subassemblies would be assembled as before and would be interconnected to the rear of the walls 416 in a similar manner to the patch panel of FIG. 2. A plurality of connectors 124 would be employed which are identical to those shown in FIG. 2 and could be interconnected to the shielded subassemblies 2. As the connectors 124 are easily removed, the connectors could be unlatched and simply reconnected to another location within the same distribution box 402. As the walls 416 are at a slight angle relative to vertical, approximately 25°, the connectors 124 are easily reached for removal and for reconnection.

Alternatively, an adapter such as 200 shown in FIG. 9 could be incorporated to the walls 416 and the adapters could be snap latched to the walls to facilitate interconnection of connectors such as 300 shown in FIG. 10. This would allow connectors which already incorporate connectors such as 300 to be utilized within the network.

A plastic cover (not shown) would complete the assembly to insulatively surround the box and to enclose the connections.

Figure 14:
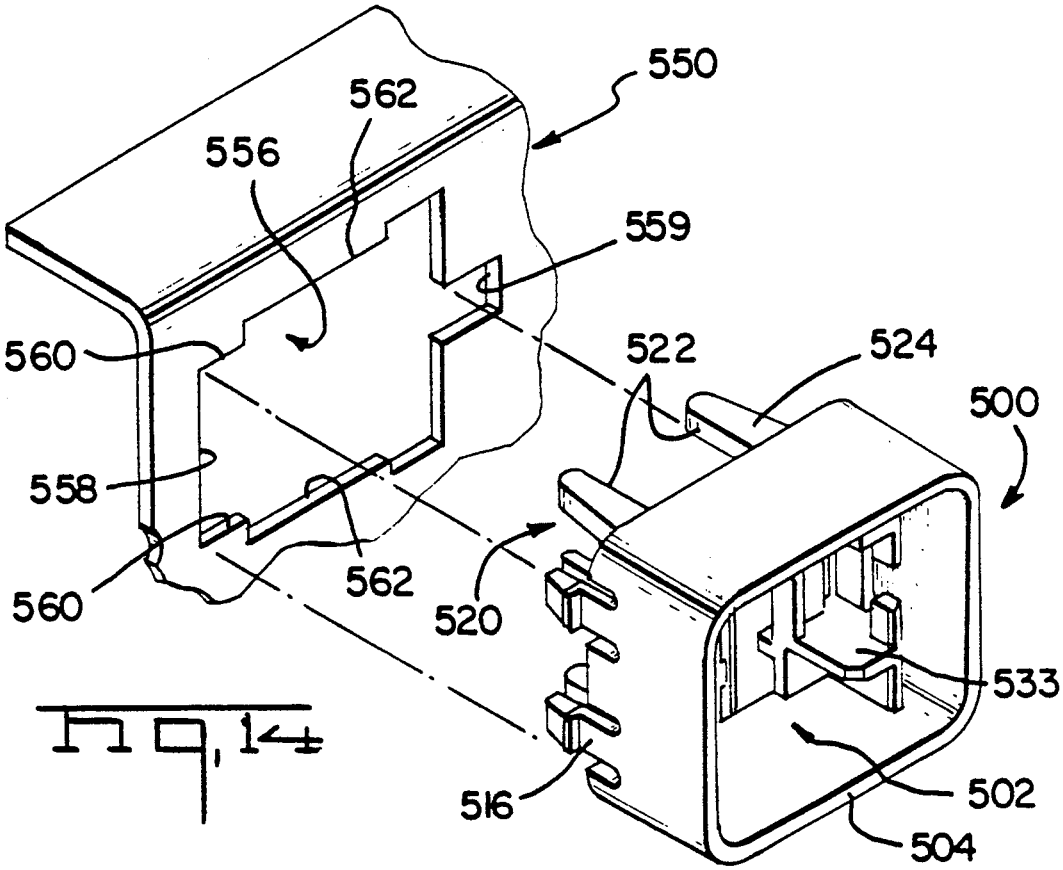
FIG. 14 is an isometric view of an alternate version of a distribution panel.

A further embodiment of the data distribution panel is shown in FIGS. 14 through 18. With reference first to FIG. 14, a panel 550 is shown which receives an insert 500. The panel 550 includes a stamped out opening 556 having a left edge 558 with a right edge 559. The opening 556 further includes upper and lower edges 562 and upper and lower edges 560 at the left hand side of the opening 556.

Figure 17:
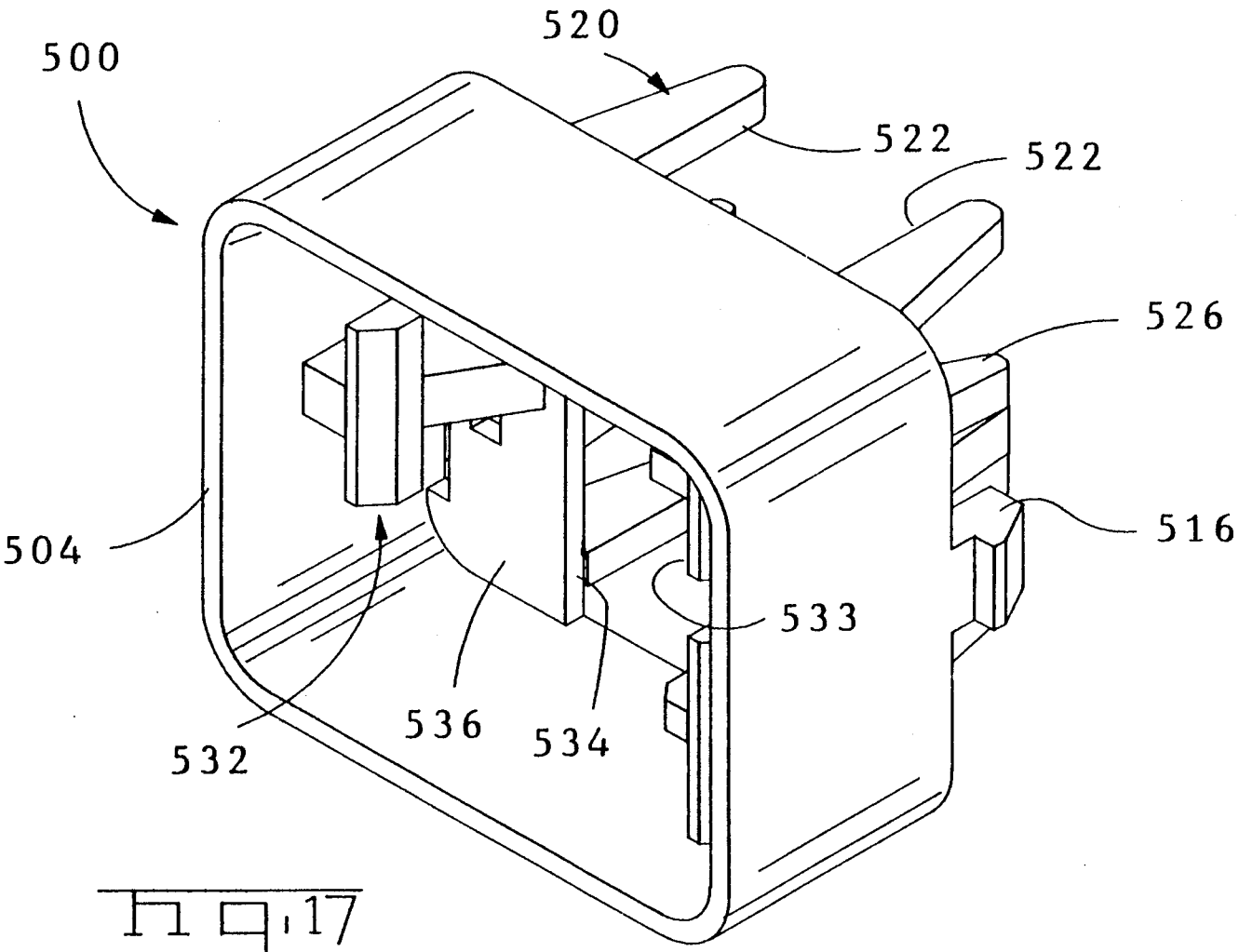
FIG. 17 is an isometric view of the face plate insert.
Figure 17G:
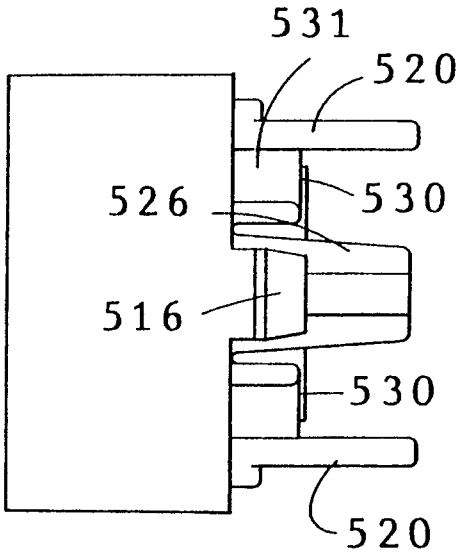
FIGS. 17F and 17G are side views of the insert shown in FIG. 17A.
Figure 17A:
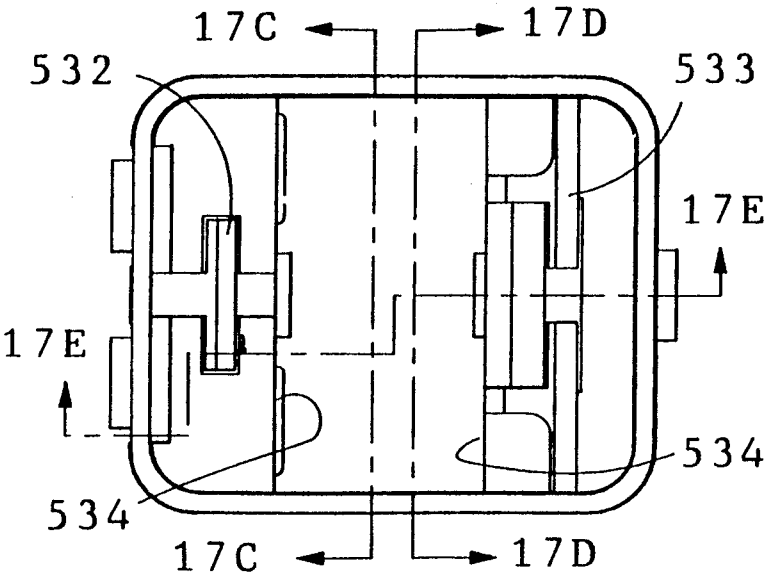
FIG. 17A is a front plan view of the face plate insert shown in FIG. 17.
Figure 17F:
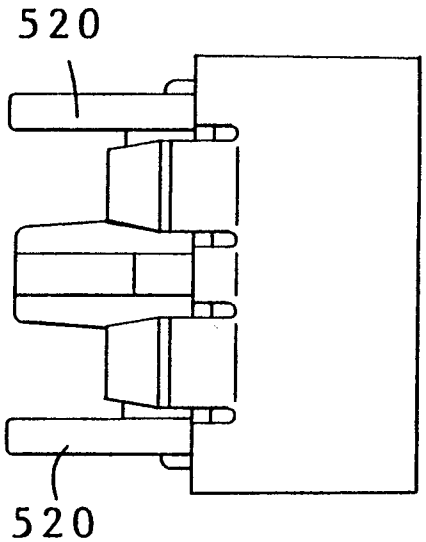
Figure 17B:
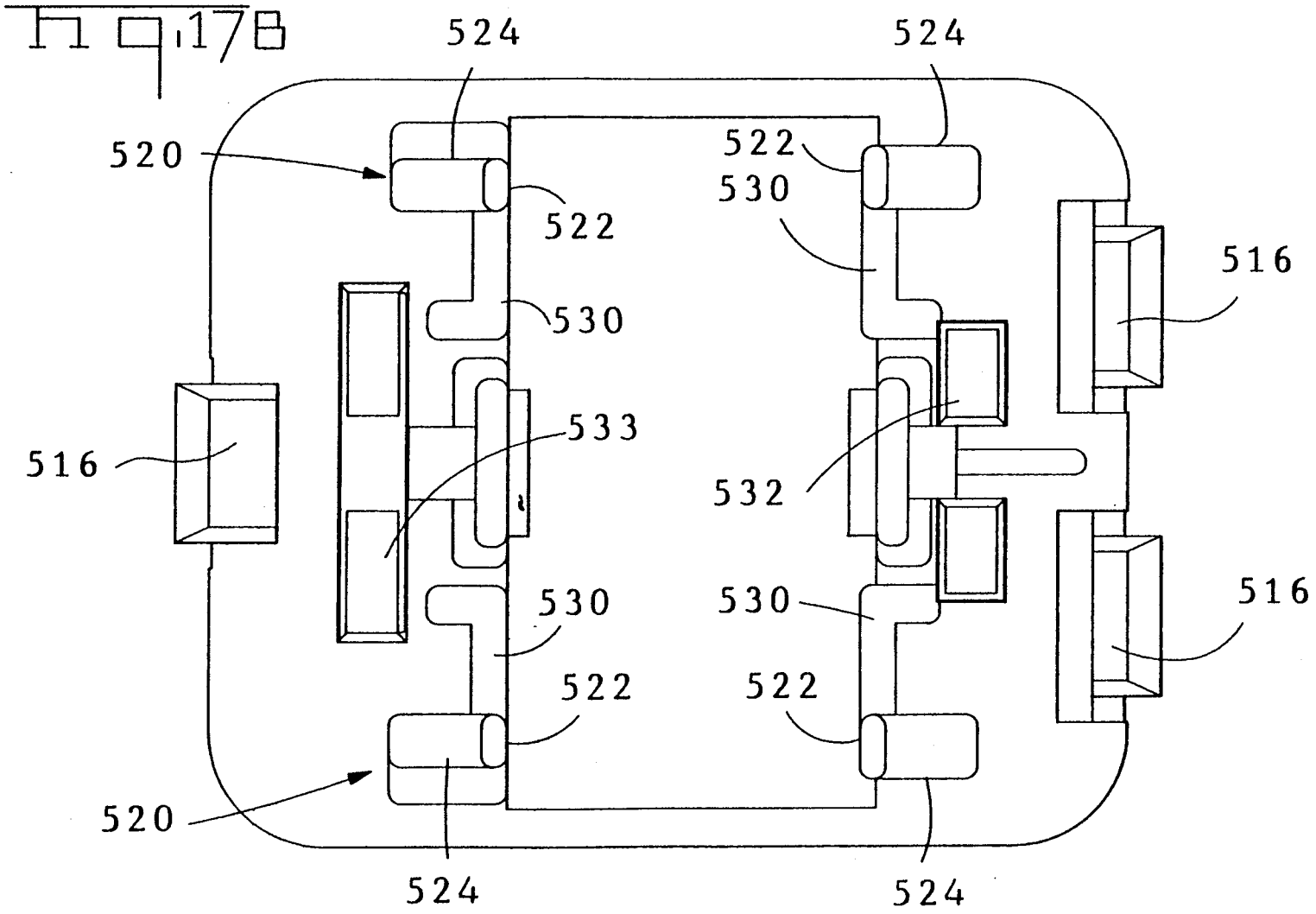
FIG. 17B is a rear plan view of the insert of FIG. 17A.

With reference now to FIGS. 17 through 17G, the insert 500 will be described in greater detail. The insert 500 includes a shroud 504 extending peripherally around the insert member and extending forwardly from a rear wall 536 (FIG. 17). The rear wall 536 is discontinuous and defines an opening through the rear wall as defined by edges 534 as shown best in FIG. 17A.

A T-bar assembly 532 extends forwardly from the rear wall 536 (FIG. 17), while a T-slot assembly 533 extends forwardly from the rear wall 536 as shown in FIG. 14. The T-bar assembly 532 and the T-slot assembly 533 span the opening created by the edges 534. The insert 500 includes on one side edge thereof two latch arms 516 (FIG. 14) while the opposite side edge includes a single latch arm 516 (FIG. 17). As shown in FIG. 17, the rear wall 536 includes alignment arms 520 extending therefrom in an opposite direction from the rear wall as the T-bar 532 and T-slot assembly 533 respectively. The alignment arms 520 include inner surfaces 522 and upper surfaces 524. A centering arm 526 is located intermediate the arms 520, as shown in FIGS. 17 and 17E, and includes a centering lug portion 528.

Figure 16:
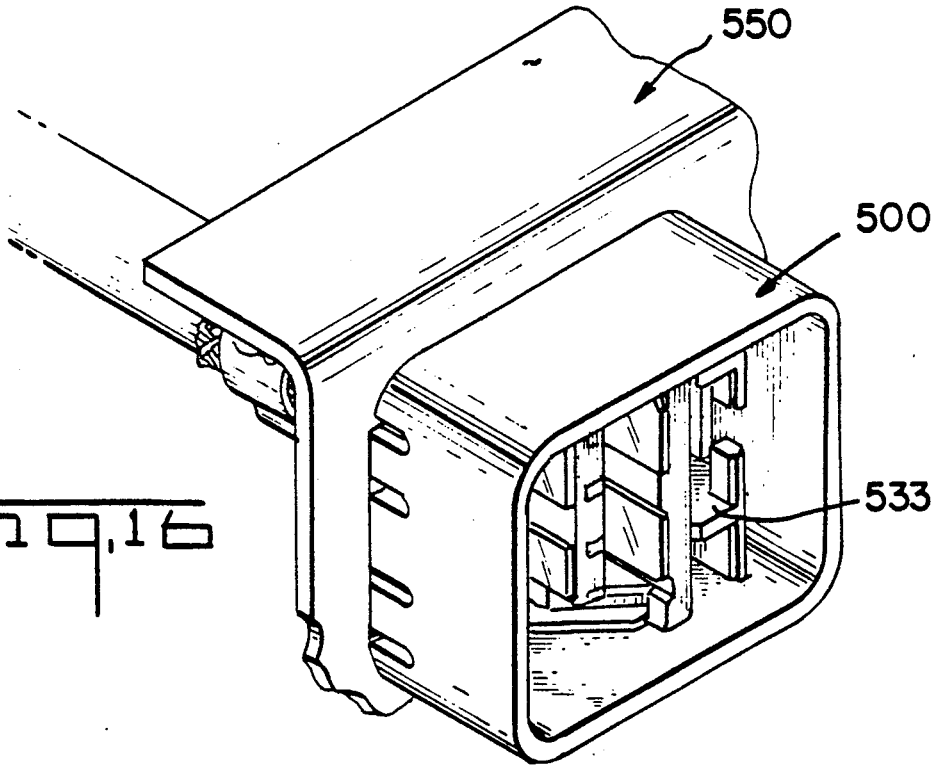
FIG. 16 is a completed assembly of the components shown in FIGS. 14 and 15.

To assemble the distribution panel into the configuration shown in FIG. 16, the individual face plate inserts 500 are aligned with the individual cutout portions 556 as shown in FIG. 14. The two latch members 516 on the left hand side of the insert, as shown in FIG. 14, are spaced to be accepted between the edges 560 of the opening 556 and latch behind the edge 558. Similarly, the latch 516 on the right hand side of the face plate 500 will be accepted behind the edge 559, thereby retaining the insert 500 to the panel 550.

Figure 15:
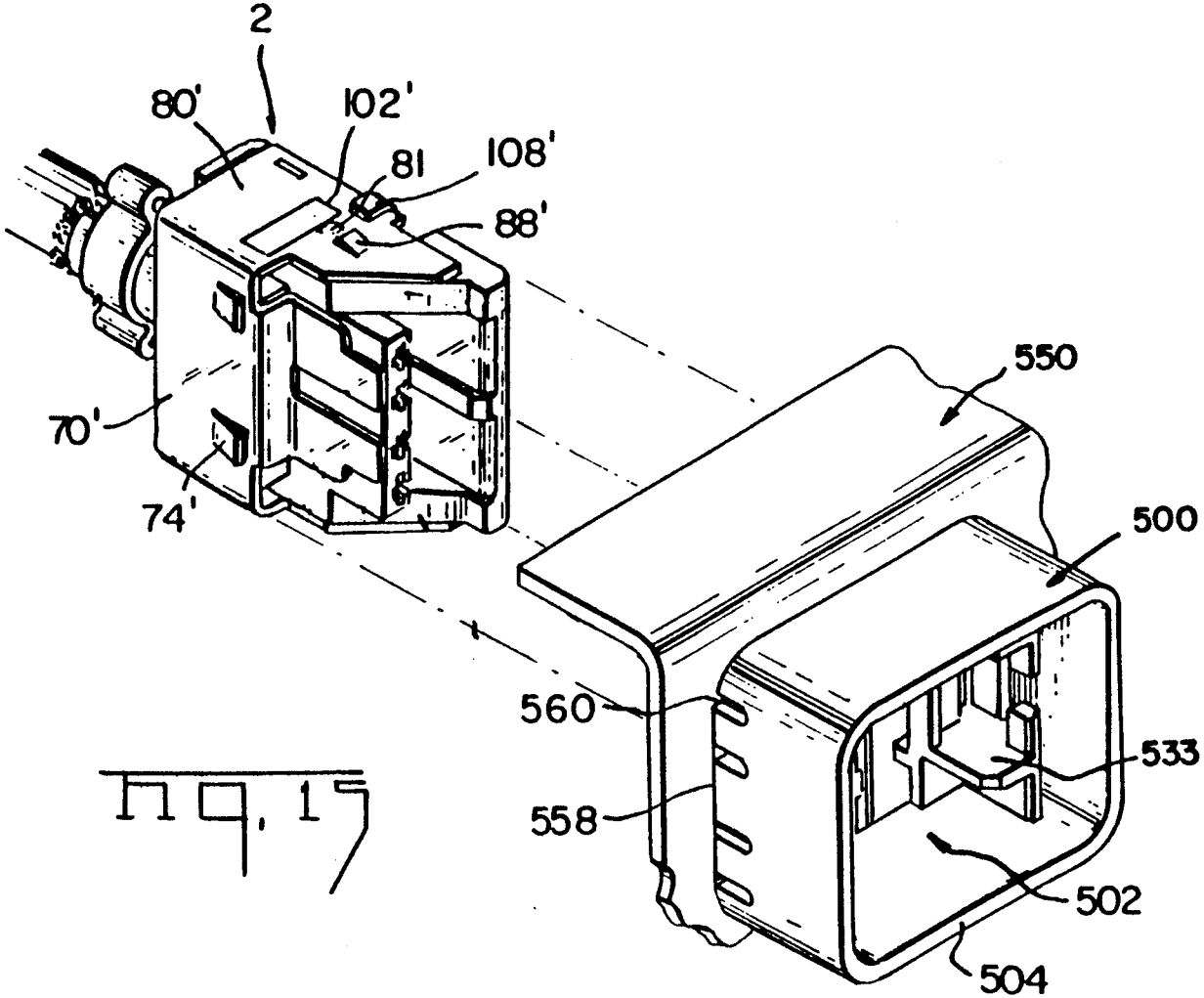
FIG. 15 shows the data connector insertable into the panel of FIG. 14.
Figure 17C:
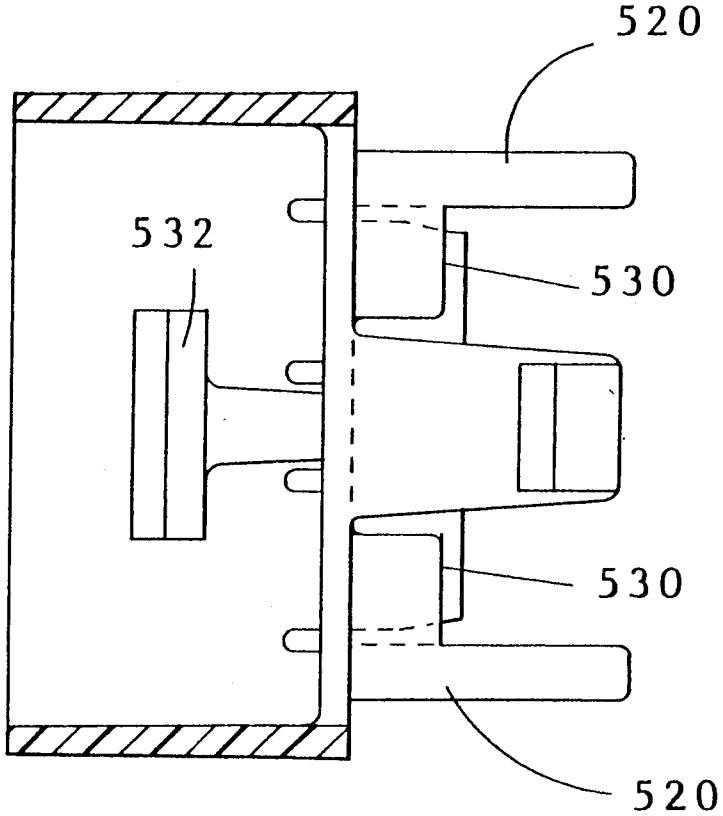
FIG. 17C is a cross sectional view through lines 17C—17C of FIG. 17A.
Figure 17D:
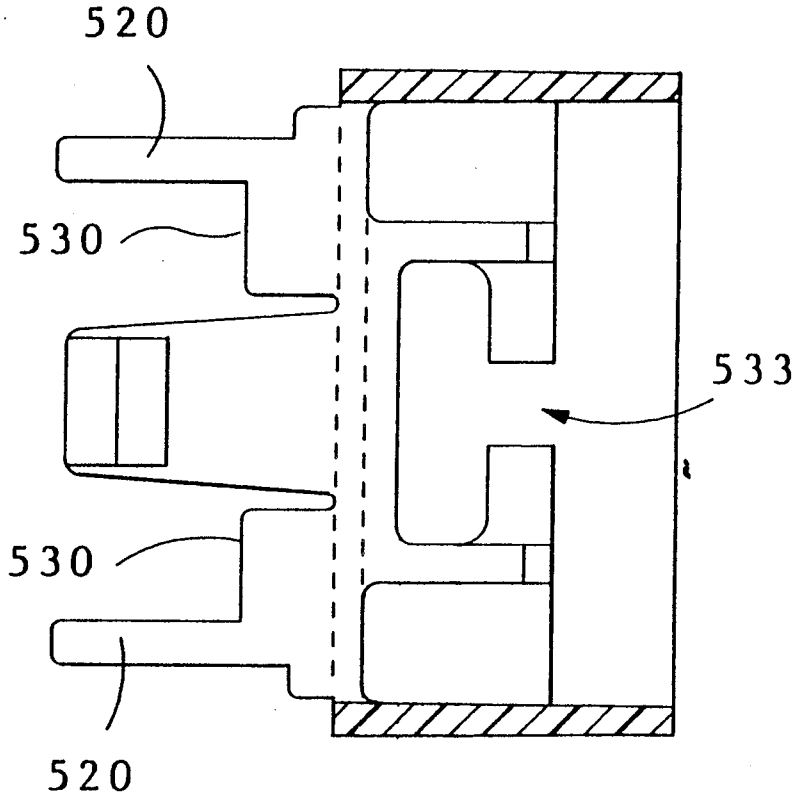
FIG. 17D is a cross sectional view through lines 17D—17D of FIG. 17A.

As shown in FIG. 15, the shielded subassembly 2' is now receivable through the rear face of the distribution panel 550 to be latched into juxtaposition relative to the face plate insert 500. The shielded subassembly 2' is identical to the shielded subassembly 2 as described above except for the indents 81 which are found on both side walls 80' of the shield members. When the shielded subassembly 2' is received through the opening 556 into the opening 502 of the insert 500, the alignment legs 524 are closely toleranced to receive the shielded subassembly therebetween. The alignment legs 520 will flank the outside of the stamped out tabs 74' on the lower shielding plate 70', and also flank the stamped out retention tabs on the top shielding plate 102'. The stamped out tabs 88' on both sides of the shielded subassembly 2', which are stamped out of the side shield plates 80', will latch into place with the end edge of the stamped out portion 88' contacting the front face of the plate 550 adjacent to edges 562. With the projections or dimples 81 directly behind the end edge of the stamped out retention portions 88' the dimples 81 will be directly engaging with the sheared edge 562 for grounding purposes. To retain the shielded subassembly 2' from moving in an opposite axial direction further through the panel opening 556, feet portion 530 (FIGS. 17C and 17D) are located inwardly of the alignment arms 520 and receive stamped out tab portions 74' in engagement therewith. Thus, the shielded subassembly 2' is retained within the panel 550 and face plate assembly 500 with the retention members 88' and 74' latched between the surfaces of the front face of the panel 550 and the rear edge of the feet members 530.

Figure 17E:
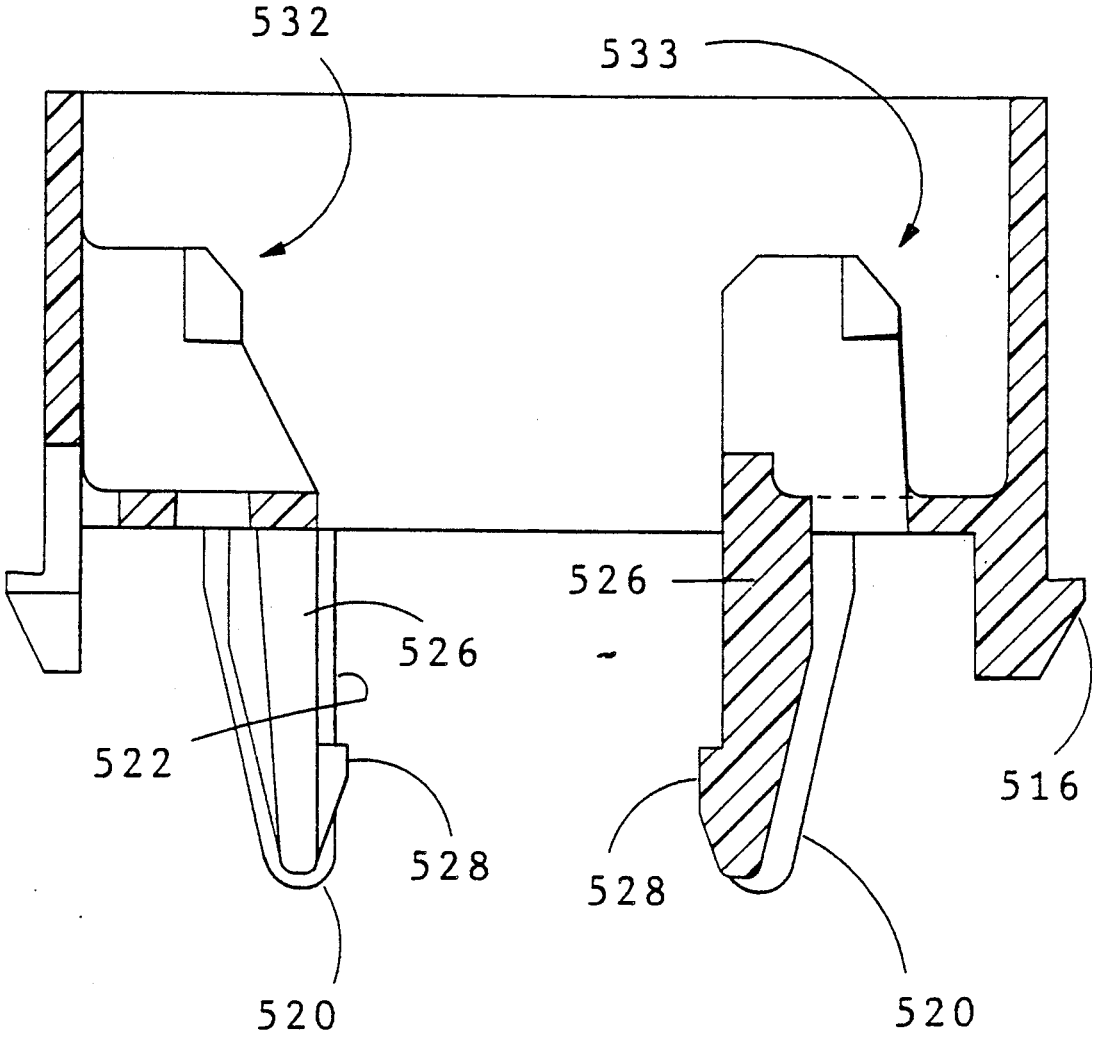
FIG. 17E is a cross sectional view through lines 17E—17E of FIG. 17A.

As best shown in FIG. 17E, a centering arm 526 is located between the alignment arms 520 where each of the arms 526 includes a lug portion 528. As can be seen in the left hand side of FIG. 17E, the lug portion 528 extends laterally beyond edge 522 of the alignment arm 520. Thus when the shielded subassembly is inserted in place between the two alignment arms 520 adjacent surfaces 522, the centering arms 526 actually flex outwardly to the extent needed such that surfaces 528 and 522 are coplanar, providing a further strain retention and centering function.

Figure 18:
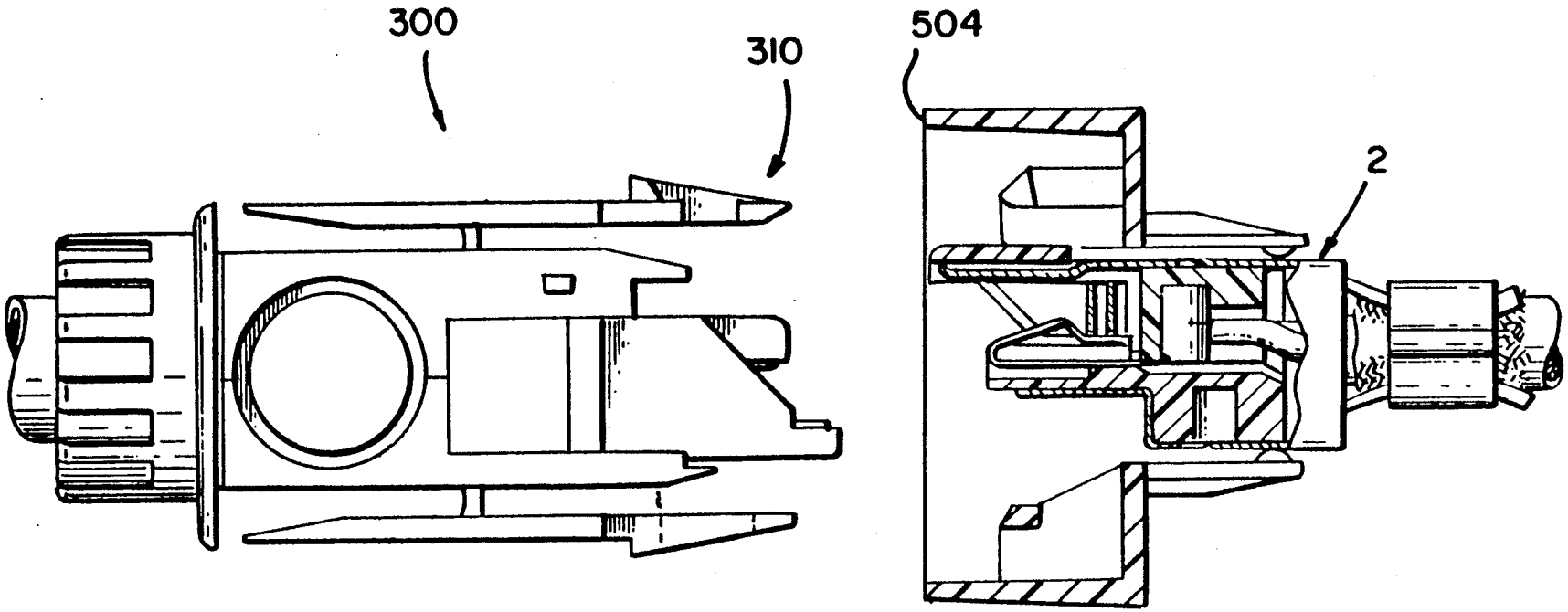
FIG. 18 is a longitudinal section view of the completed assembly of FIG. 16 with a mating connector poised for receipt thereinto.

Referring to FIG. 18, with the shielded subassembly so installed within the panel, each of the shielded subassemblies and inserts cooperatively provide for an interface to a data connector 300 which was previously described.

The preferred embodiment of the invention was disclosed by reference to the specific drawings herein and with specific reference to the terminology used in the state of the art to which the invention relates in order to illustrate and exemplify the preferred practice of the invention, but not to restrict its scope; the appended claims being reserved to that end.

What is claimed:

1. A data distribution interface for interconnection to an electrically shielded cable, and for the matable interconnection of a shielded data connector; the interface comprising:

(a) a shielded subassembly comprising:

(i) an insulative housing means having terminal supporting means including a platform for the receipt of a plurality of electrical terminals, and sidewalls upstanding from the platform, the platform and the sidewalls defining an open upper face of the housing means, (ii) a plurality of electrical terminals including base portions for mounting on the platform in transition with reversely bent portions forming resilient contact portions, the contact portions extending rearwardly to free ends of the terminals, the contact portions being intermatable with like contact portions in a complementary connector, the terminals further comprising wire connecting portions extending from ends of the terminal base portions, (iii) an insulative cap member, securable within the housing means, including means for aligning individual wires of the shielded cable with selected wire connecting portions, (iv) shield means securable to the housing means, and substantially enclosing the exterior of the sidewalls, the exterior of the platform, and the open upper face of the platform, thereby overlying the terminal wire connecting portions, the insulative cap member providing a spaced relation between the shield means and the wire connecting portions of the terminals;

(b) a conductive panel means comprising an opening therethrough for the receipt of the shielded subassembly, the panel means and the shielded subassembly cooperatively including commoning means to common the shield means directly to the panel means; and (c) means for retaining the shielded subassembly to the panel means in a secured relation.

2. The interface of claim 1 wherein the shield means comprises upper and lower shield members.

3. The interface of claim 1 wherein the shield means has at least one first tab struck outwardly therefrom, the first tab projecting rearwardly and abutting a front face of the panel means retaining the axial position of the shielded subassembly in one direction.

4. The interface of claim 3 wherein the shield means has at least one second tab struck outwardly therefrom, the second tab projecting forwardly and abutting a free end of the finger retaining the axial position of the shielded subassembly in an opposite direction as said one direction.

5. The interface of claim 1 wherein the commoning means comprises a finger integral with the panel means, which projects towards the shielded subassembly and is in a contacting relation therewith, to common the shielded subassembly to the panel means.

6. The interface of claim 4 wherein the finger projects rearwardly.

7. The interface of claim I wherein the commoning means is provided by a projection on at least one surface of the shield means, the projection being in contact with an edge of the opening in the panel.

8. The interface of claim 7 wherein the projection is defined as a dimple on the shield means which contacts an edge of the opening means.

9. A data distribution interface for interconnection to an electrically shielded cable, and for the matable interconnection of a shielded data connector which includes hermaphroditic latching members; the interface comprising:

(a) a shielded subassembly comprising:

(i) an insulative housing means having terminal supporting means including a platform for the receipt of a plurality of electrical terminals, and sidewalls upstanding from the platform, the platform and the sidewalls defining an open upper face of the housing means, (ii) a plurality of electrical terminals including base portions for mounting on the platform, the base portions being in transition with reversely bent portions forming resilient contact portions, the contact portions extending rearwardly to free ends of the terminals, the contact portions being intermatable with like contact portions in a complementary connector, the terminals further comprising wire connecting portions extending from ends of the terminal base portions, (iii) shield means securable to the housing means, and surrounding the exterior of the sidewalls, the exterior of the platform, and enclosing the open upper face of the platform, (b) a conductive panel means comprising an opening therethrough for the receipt of the shielded subassembly, the shielded subassembly extending at least partially through the opening means and being commoned to the panel means; and (c) a face plate means which is securable to the panel means, over the opening means, and which integrally incorporates therein the mating profile of the hermaphroditic latching members.

10. The interface of claim 9 wherein the face plate means is comprised of an insulative material and includes a complementary T-bar and T-slot which is matable with a respective T-slot and T-bar of the matable shielded data connector.

11. The interface of claim 9 wherein the face plate means is snap latchable to the panel means.

12. The interface of claim 10 wherein the face plate means includes at least two alignment legs extending from the rear of the face plate means to retain the shielded subassembly in position.

13. The interface of claim 12 wherein the face plate means includes two pairs of opposed alignment legs, the alignment legs being spaced apart to receive between them, the shielded subassembly.

14. The interface of claim 13 wherein a pair of centering arms is further included, extending from the rear of the face plate means, the centering arms being opposed from each other and having a projection thereon which, when in their undeflected position, provides a spacing therebetween which is narrower than the shielded subassembly.

15. A data distribution interface for interconnection to an electrically shielded cable, and for the matable interconnection of a shielded data connector; the interface comprising:

a shielded subassembly where each subassembly comprises:

an insulative housing means including a terminal support platform, two sidewalls upstanding from the platform forming an open upper face of the base;

a plurality of electrical terminals, positioned along and supported by, the terminal support platform, each of the electrical terminals including a resilient contact portion for interconnection to like contact portions in a complementary electrical connector;

shield means assembled to said housing, with at least one first tab means struck outwardly from the shield means; and a conductive panel means comprising an opening therethrough for the receipt of the shielded assembly, the panel means including at least one integral finger extending from the panel means into the opening in alignment with the first tab means of the shield means, the finger being in contact against the shield means to common the shield means to the panel means, and the finger being in an abutting relation with the first tab means to prevent movement of the insulative housing in at least one direction.

16. The interface of claim 15 wherein the shielded subassembly is insertable through a rear face of the panel means for disposition within the opening.

17. The interface of claim 16 wherein the resilient finger extends rearwardly while the first tab means extends forwardly in an abutting relation with the finger.

18. The interface of claim 17 wherein the shield means further comprises second tab means which extend outwardly from the shield means to abut a front face of the panel means.

19. A data distribution assembly acting as an interface between first and second destinations with a data distribution system, the assembly comprising:

a plurality of first shielded data cables including a plurality of data conductors having a shielding braid surrounding the conductors, the first shielded data cable having first and second ends where the first end is interconnected to a first destination;

a plurality of first electrically shielded connectors arranged in an array where each connector is electrically interconnected to one of the first shielded data cables and where each connector comprises an insulating housing which supports a plurality of electrical terminals, equal in number to the plurality of data conductors, the terminals being interconnected to the data conductors through insulation displacement portions, the terminals further comprising resilient contact portions for interconnection to similar contact portions in a similar connector, the shielded connectors including shield means in a surrounding relation to the insulative housings, where each shield means includes means for interconnection to the associated shielding braid;

a plurality of second shielded data cables including a plurality of data conductors having a shielding braid surrounding the conductors, the second shielded data cables each having first and second ends where the first end is interconnected to a second destination;

a plurality of second electrically shielded connectors arranged in an array where each connector is electrically interconnected to one of the second shielded data cables and where each connector comprises an insulating housing which supports a plurality of electrical terminals, equal in number to the plurality of data conductors, the terminals being interconnected to the second data conductors through insulation displacement portions, the terminals of the second connectors further comprising resilient contact portions for interconnection to similar contact portions in a similar connector, the second shielded connectors including shield means in a surrounding relation to the insulative housings, where each shield means includes means for interconnection to the associated shielding braid;

a conductive panel means for the assemblage of the arrays of first and second data connectors, the panel means including means to directly contact individual shield means of individual first and second shielded connectors, thereby commoning the shielding braids via the individual shield means of first and second connectors; and a plurality of patch cables where each patch cable includes shielded data cable having shielded patch connectors at opposite ends of each patch cable, the patch connectors being matable with first and second shielded connectors to provide a variable of interconnections between first and second destinations.

20. A network data distribution box for interconnection to an electrically shielded cable, and for the matable interconnection of a shielded data connector; the distribution box comprising:

a conductive box at least partially enclosed having at least one interconnection wall upstanding from a base wall and extending at least partially across the base wall, the interconnection wall including a plurality of openings;

a shielded subassembly where each subassembly comprises:

an insulative housing means including a terminal support platform, two side walls upstanding from the platform forming an open upper face of the base;

a plurality of electrical terminals, positioned along and supported by, the terminal support platform, each of the electrical terminals including a resilient contact portion for interconnection to like contact portions in a complementary electrical connector;

shield means assembled to said housing means;

each of the shielded subassemblies being installed within an opening with the shield means commoned to the base wall, and a face plate means which is securable to the interconnection wall and which integrally incorporates therein the mating profile of hermaphroditic latching members of a hermaphroditic data connector.

21. The distribution of claim 20 wherein two interconnection walls extend at least partially across the base wall.

22. The distribution box of claim 20 wherein the face plate means is comprised of an insulative material and includes a complementary T-bar and T-slot which is matable with a respective T-slot and T-bar of the matable hermaphroditic data connector.

23. A network data distribution box for interconnection to an electrically shielded cable, and for the matable interconnection of a shielded data connector; the distribution box comprising:

a conductive box at least partially enclosed having at least one interconnection wall upstanding from a base wall and extending at least partially across the base wall, wherein the walls are at an angle relative to vertical to project a front mating face of the shielded subassemblies upward, the interconnection wall including a plurality of openings;

a shielded subassembly where each subassembly comprises:

an insulative housing means including a terminal support platform, two side walls upstanding from the platform forming an open upper face of the base;

a plurality of electrical terminals, positioned along and supported by, the terminal support platform, each of the electrical terminals including a resilient contact portion for interconnection to like contact portions in a complementary electrical connector;

shield means assembled to said housing means;

each of the shielded subassemblies being installed within an opening with the shield means commoned to the base wall.

24. The distribution box of claim 23 further comprising a face plate means which is securable to the interconnection wall and which integrally incorporates therein the mating profile of hermaphroditic latching members of a hermaphroditic data connector.

25. The distribution box of claim 24 wherein the face plate means is comprised of an insulative material and includes a complementary T-bar and T-slot which is matable with a respective T-slot and T-bar of the matable hermaphroditic data member.

26. The distribution box of claim 23 wherein two interconnection walls extend at least partially across the base wall.

27. The distribution box of claim 26 wherein the openings in one of the interconnections walls are laterally staggered from the openings in the other interconnection wall.

28. A network data distribution box for interconnection to an electrically shielded cable, and for the matable interconnection of a shielded data connector; the distribution box comprising:

a conductive box at least partially enclosed having at least two interconnection walls upstanding from a base wall and extending at least partially across the base wall, the interconnection wall including a plurality of openings; the openings in one interconnection wall being laterally staggered from the openings in the other interconnection wall;

a shielded subassembly where each subassembly comprises:

an insulative housing means including a terminal support platform, two side walls upstanding from the platform forming an open upper face of the base;

a plurality of electrical terminals, positioned along and supported by, the terminal support platform, each of the electrical terminals including a resilient contact portion for interconnection to like contact portions in a complementary electrical connector;

shield means assembled to said housing means;

each of the shielded subassemblies being installed within an opening with the shield means commoned to the base wall.

* * * * *